US011053612B2

(12) United States Patent
Evenepoel et al.

(10) Patent No.: US 11,053,612 B2
(45) Date of Patent: Jul. 6, 2021

(54) JET AND METHOD

(71) Applicant: Gilbos N.V., Aalst (BE)

(72) Inventors: Hans Evenepoel, Oudegem (BE); Erik Gilbos, Dikkelvenne (BE); Sigurn Vandenbrande, Dentergem (BE); Björn Quidé, Moorsel (BE)

(73) Assignee: Gilbos N.V., Aalst (BE)

( * ) Notice: Subject to any disclaimer, the term of this patent is extended or adjusted under 35 U.S.C. 154(b) by 67 days.

(21) Appl. No.: 15/774,633

(22) PCT Filed: Nov. 9, 2016

(86) PCT No.: PCT/IB2016/001662
§ 371 (c)(1),
(2) Date: May 9, 2018

(87) PCT Pub. No.: WO2017/081536
PCT Pub. Date: May 18, 2017

(65) Prior Publication Data

US 2018/0347076 A1 Dec. 6, 2018

(30) Foreign Application Priority Data

Nov. 10, 2015 (BE) ..... 2015/5734

(51) Int. Cl.
*D02G 1/16* (2006.01)
*D02G 3/28* (2006.01)
(Continued)

(52) U.S. Cl.
CPC ..... *D02G 1/16* (2013.01); *D02G 1/04* (2013.01); *D02G 3/286* (2013.01); *D02J 1/08* (2013.01)

(58) Field of Classification Search
CPC .. D02G 1/16; D02G 1/04; D02G 3/286; D02J 1/08
(Continued)

(56) References Cited

U.S. PATENT DOCUMENTS 3,225,533 A 12/1965 Henshaw
3,306,023 A 2/1967 Henshaw
(Continued)

FOREIGN PATENT DOCUMENTS

EP 0368108 A1 5/1990
JP S51143746 A 12/1976
WO 2012059560 A1 5/2015

OTHER PUBLICATIONS

Chau, Shiu-Wu et al.; "Determination of Yarn Interlacing Frequency of Triangular Interlacing Nozzles through a Compressible Flow Simulation"; Textile Research Journal, vol. 78, No. 8, Aug. 2008, pp. 699-709, pp. 705-706, Figures7-8.
(Continued)

*Primary Examiner* — Shaun R Hurley
*Assistant Examiner* — Patrick J. Lynch
(74) *Attorney, Agent, or Firm* — James Creighton Wray

(57) ABSTRACT

An improved system for fabricating alternating S/Z cabled yarn, for alternating S/Z twisted yarn and for (whether or not alternately) applying a torsion to a yarn, in which critical air flow conditions are obtained at least at the outlet of the torsion chamber of the devices. A method for fabricating alternating S/Z cabled yarn, for alternating S/Z twisted yarn and for (whether or not alternately) applying a torsion to a yarn under critical air flow conditions at least at the outlet of the torsion chamber used in the method, and a product according to these methods.

6 Claims, 8 Drawing Sheets

(51) Int. Cl.
*D02J 1/08* (2006.01)
*D02G 1/04* (2006.01)

(58) Field of Classification Search
USPC ..... 57/293, 350, 908
See application file for complete search history.

(56) References Cited

U.S. PATENT DOCUMENTS 3,353,344 A 11/1967 Clendening
3,434,275 A 3/1969 Backer
3,443,370 A 5/1969 Walls
3,507,108 A 4/1970 Yoshimura
3,717,988 A 2/1973 Walls
RE27,717 E 8/1973 Breen
3,775,955 A 12/1973 Shah
3,898,719 A * 8/1975 Lloyd ..... D02J 1/08 28/274
3,940,917 A 3/1976 Strachan
4,004,329 A * 1/1977 London, Jr. ..... D02G 1/16 28/274
4,074,511 A * 2/1978 Chambley ..... D02G 3/286 28/220
4,083,172 A * 4/1978 Norris ..... B65H 61/005 28/276
4,450,675 A * 5/1984 Petrov ..... D02G 3/343 57/12
4,621,490 A 11/1986 Kawabata
5,392,588 A * 2/1995 Morrison ..... D01H 1/11 57/224
5,557,915 A * 9/1996 Knoff ..... D02G 3/286 57/204
5,644,909 A 7/1997 Knoff
9,898,719 B2 2/2018 Godsey
2002/0029554 A1* 3/2002 Belcher, Jr. ..... D02G 1/20 57/333
2013/0205741 A1* 8/2013 Gilbos ..... D02G 3/286 57/204
2015/0329994 A1* 11/2015 Schaffler ..... D01H 4/08 57/410
2016/0348289 A1* 12/2016 Shah ..... D02G 3/286

OTHER PUBLICATIONS

Versteeg H.K. et al.; "Effects of Geometry on the Flow Characteristics and Texturing Performance of Air-Jet Texturing Nozzles", Textile Research Journal, vol. 64, No. 4, Apr. 1996, pp. 240-246, p. 244, col. 2—p. 245, col. 1.

* cited by examiner

JET AND METHOD

TECHNICAL FIELD

The invention relates to an improved torsion member for applying an alternating S/Z twist (or false twist) in one or more yarns, and in general to improved devices and methods for fabricating alternating S/Z cabled yarns and intermediate products thereof.

STATE OF THE ART

For practical considerations, general descriptions are included here with respect to the processes and products to which the present application relates.

It is possible to fabricate twist plied yarn by providing different yarns with a so-called "false twist" or an alternating S/Z twist, partially connecting the different yarns, at which the different yarns intertwine under the influence of the torsion of the false twist.

This has been described conceptually in the following documents: "Self-Twist Yarn", D. E. Henshaw, Merrow Publishing C°, Ltd., Watford, Herts, England, 1971; RE 27,717 Breen et al; U.S. Pat. No. 3,225,533 Henshaw; U.S. Pat. No. 3,306,023 Henshaw et al.; U.S. Pat. No. 3,353,344 Clendening, Jr.; U.S. Pat. No. 3,434,275 Backer et al.; U.S. Pat. No. 3,443,370 Walls; U.S. Pat. No. 3,507,108 Yoshimura et al.; U.S. Pat. No. 3,717,988 Walls; U.S. Pat. No. 3,775,955 Shah and U.S. Pat. No. 3,940,917 Strachan. Additionally, a process for fabricating an alternating S/Z cabled yarn has been described in the patent document WO 2012/059560.

A first problem with the known systems, appliances, apparatus and devices for alternatively applying a, respectively, S and Z torsion in a yarn, is that they cannot ensure a sufficiently central stabilization of the yarn that passes through the jet, so that the yarn cannot be positioned sufficiently precise with respect to the air flow. Considering the extreme high speed with which the yarn passes, it is however very important because deviations are largely increased and are difficult to correct. In this way, along a very large length, yarn cannot be provided with sufficient torsion, which is detrimental for the end product.

Another problem is that it is difficult to obtain a stable, constant air flow around the yarn, that must guarantee a fixed torsion and twist in the yarn. In practice, it is very important to provide an air flow that is as uniform as possible, thus obtaining a uniformly twisted yarn, that can in this way also intertwine with other yarns in a reliable manner. The known systems cannot sufficiently regulate the air flow to guarantee a high-quality product.

In the granted patent U.S. Pat. No. 4,621,490, in an attempt to obtain this central stabilization of the yarn, one or more contact points are provided for the yarn, at least one at the inlet of the chamber in which the alternating twist is applied. In this way, deviations (for example vibrations) can be compensated or even avoided so that the yarn can pass uninterrupted (of less interrupted) through the chamber. A first problem in this respect is that the yarn is as a result thereof interrupted in another way, and for example can be flattened before entering the chamber. A second large problem is that, considering the extreme high speeds of the yarn, this leads to friction that is detrimental for the quality of the yarn, and can even cause rupture. Rupture of the yarn can have big consequences for the production line that runs at such speeds. A last problem is that the air flow that is generated, is not improved in any way in aspects of uniformity.

Another possible improved so-called air jet spinning device is suggested in EP 0,368,108, in which a spinning device for alternating S/Z cabled yarns is released, in which twisting the yarns is carried out via air jets. However, this device is adapted to suck in free ends of yarns, that are supplied via feed rolls via a vacuum source, in which they eventually tack in a further twisting chamber and thus pass through the device. This tacking continues up to the feed rolls. The improvement of this device compared to other systems is that the generated air flow is oriented under an angle of 30°-40° with respect to the longitudinal axis of the device, in order to ensure in this way a better suction of the air flow through the device at a desired speed. The document further does not describe any measures to come to a more sable tangential air flow around the longitudinal axis of the device, only along the longitudinal axis.

A tacked yarn has in some extent already been described in U.S. Pat. No. 3,898,719, while a manipulated yarn has already been described in JP S51/143746. The applicant has however noticed that the methods for obtaining these according to said documents cannot in any way lead to a qualitative product in the long term, as well as other technical problems.

There is a need for an improved torsion member that ensures a stable, far-reaching tangential air flow in order to reach, in this way, a more stable yarn passage along an central axis in the torsion member, preferably in advantageous working conditions for the device as to pressure, air speed, yarn speed and other factors. As said, a more stable tangential airflow ensures a more uniformly twisted yarn. Moreover, this leads to a more stabilized central yarn passage, that still reinforces the uniform twist as the speed of the tangential air flow depends on the place. By passing the yarn centrally with limited deviations, the yarn, that passes through the torsion member, also experiences a constant tangential air flow, possibly with limited deviations. Additionally, it is possible to provide yarns with a higher and more constant quality, and this in increased volumes, as the speed with which the yarn passes through the device, often has to be limited because of different reasons. One of the main reasons therefor is that a higher speed often leads to larger deviations with respect to the central, ideal yarn passage.

Another problem is that, at the high speeds at which the yarns are pulled through the devices, it is necessary to apply high pressures in the devices to transfer a sufficiently strong torsion to the yarn, but also to guarantee stable conditions in which eddy currents that imply energy loss, can be avoided as much as possible around the yarn. Obtaining and maintaining a high pressure is energetically, and thus financially, a very expensive operation. Therefore, it is necessary to carry out the production process at a pressure that is as low as possible. At present, in most systems, an overpressure of about 9 bar is used. Obviously, this creates lots of opportunities as to energy savings, as well as maintenance of the installation. In this respect, one should keep in mind that the energy used per time unit (used capacity) can be computed here as the product of volumetric flow rate and pressure (absolute). If the production process can be carried out at lower pressures, not only a lot of energy could be saved, but also a lot of material, as the devices must at present be able to run at long-term and very high overpressures, and a lot of many must therefore be invested in the device and the device is more difficult to regulate. Furthermore, the higher pressure at which the conventional systems, is also partially necessary to reach a sufficiently high air mass density, as a result of which the air can better interact with the filaments of the yarn This specific problem, as well as most of the other problems, occurs in different subsystems that are used for fabricating cabled alternating S/Z twist plied yarn, or connected alternating S/Z twist plied yarn or (connected or not) false-twisted yarn or alternating S/Z twist plied yarn. Possible subsystems are air jet devices (for applying a false twist or an alternating S/Z torsion) for example as part of a twisting device or of a cabling device, tacking devices (for joining separate yarns). For this reason, the solutions described in this document also apply to all such systems.

A last problem with the conventional systems is that they create big losses because of shock waves, and resulting uncontrolled air flows, at the air inlets to the chamber, because entering air expands too much and thus causes a supercritical air flow. Such air flows involve big energy losses and moreover, cause a less controlled air flow, while it is crucial that the air flow in the chamber can be controlled in order to apply a uniform twist or force to the yarns that pass through the chamber.

The present invention aims to find a solution for at least some of said problems.

SUMMARY OF THE INVENTION

In a first aspect, the invention relates to a method for manipulating one or more yarns through an air flow, comprising the steps:

a. leading the one or more yarns through an air jet device, in which the air jet device comprises a chamber with a yarn inlet, a yarn outlet and one or more air inlets, in which the one or more yarns are led through the chamber from the yarn inlet to the yarn outlet;

b. creating an air flow in the chamber while the one or more yarns are passed through the chamber, in which the air flow is generated by introducing air in the chamber under an overpressure via the one or more air inlets through air inlet channels, in which the introduced air leaves the chamber through the yarn inlet and the yarn outlet;

c. manipulating the one or more yarns by the air flow;

characterized in that the air flow is a critical flow at the yarn outlet, and in which the air flow is preferably also a critical flow at the yarn inlet.

In a further embodiment, the method comprises a step in which, after manipulating the one or more yarns, one single yarn or one substantially twist plied yarn or one substantially cabled yarn or one textured yarn or one tacked yarn is led through the yarn outlet. Logically, this means that after manipulating one yarn, one single yarn is led, or that after manipulating more yarns, one substantially twist plied yarn or one substantially cabled yarn or one textured yarn or one tacked yarn is led through the yarn outlet.

In a further embodiment, the overpressure lies within a predetermined range and the introduced air has a mass flow rate within a predetermined range, and the predetermined range of the overpressure and the predetermined range of the mass flow rate of the introduced air are such that the critical flow at the yarn inlet, and preferably also a critical flow at the yarn outlet, is provided. As it is preferred in the above-mentioned embodiment that the air flow is a critical air flow at the yarn outlet, the air flow at the yarn inlet is also ideally a critical air flow.

In a further embodiment, the predetermined range at the air inlets is between 1 bar and 7 bar, preferably between 2 bar and 5 bar, and more preferably about 3 bar.

In a further embodiment, the critical flow is provided at the yarn outlet, and preferably also at the yarn inlet, taking into account a known diameter of the one or more yarns at the yarn outlet and/or at the yarn inlet.

In a further embodiment, the yarn outlet has a cross section, and the air inlet channels have cross sections. Here, the ratio of the cross section of the yarn outlet to the cross section of the air inlet channels that generates the air flow, is between 1.5 and 8, preferably between 2 and 6. Possibly, the range of this ratio can have higher and/or lower extreme values, for example between 1 and 10, or more precisely, such as 2.5, 3.5, 4, 4.5, 5, 5.5, 6, 6.5, 7 and/or 7.5.

In a further embodiment, the manipulation of the one or more yarns comprises the application of a torsion on the one or more yarns, and the air flow in the chamber is substantially tangential and suitable for applying a torsion to the one or more yarns.

In the rest of this document, when using the term 'torsion', the sense of torsion is taken into account, namely S torsion or Z torsion, the above-mentioned method is amongst other things suitable for applying an S or Z torsion to one or more yarns In a further embodiment, manipulating the one or more yarns comprises applying an alternating S and Z torsion to the one or more yarns, and the air flow in the chamber is substantially tangential and suitable for applying an alternating S and Z torsion to the one or more yarns. The substantial tangential air flow is suitable for applying a torsion to the yarns, and by periodically inversing the turning direction of the generated air flow, the alternating S and Z torsion can be applied to the yarns.

In an alternative embodiment, manipulating the one or more yarns comprises tacking filaments of the one or more yarns, and the air flow is introduced in the chamber, along a longitudinal axis of the chamber, so that the air flow is split in two substantial parallel vortexes with opposite rotation direction. The vortexes are suitable for tacking the filaments of the one or more yarns.

In an alternative embodiment, manipulating the one or more yarns by or through the air flow comprises applying a false twist to the one or more yarns, in which the air flow in the flow is substantially tangential and suitable for applying a false twist to the one or more yarns.

Furthermore, the applicant remarked that creating an air flow in the chamber through the air inlets and/or air inlet channels occurs such that the air flow at the air inlets is also a critical flow, with a similar result. However, for optimizing the method and the (air jet) devices according to the invention, a critical flow at the air inlets is in no way a condition, but it can possibly lead to a more uniform air flow in the (air jet) devices self (or in any case in the 'belly' thereof), as whirling can be suppressed more. In order to obtain also this critical flow, the cross-section of the air inlet channels and/or the cross-section of the air inlets and/or the flow rate of the air flow through the air inlet channels and/or the overpressure with which the air is introduced in the chamber, can be adapted to each other to enable the critical flow at the air inlets, as well as to further parameters that have already been discussed in this document. This applies to the method as well as to the (air jet) device.

In a second aspect, the invention relates to a method for fabricating alternating S/Z twist plied yarns, and the method comprises the following steps:

a. separately introducing at least two yarns through a separate air jet device with a chamber, in which the chamber comprises a yarn inlet, a yarn outlet and one or more air inlets, in which the one or more yarns are led through the chambers from the yarn inlet to the yarn outlet;

b. alternately applying S and Z torsion to the yarns in the chamber, in which zones of S torsion are alternated by zones of Z torsion and vice versa, with in between short zones with approximately no twist, and in which the S and Z torsion is applied via a substantially tangential air flow around the yarns, in which the air flow is generated by introducing under an overpressure air in the chamber via the one or more air inlets, in which the introduced air leaves the chamber via the yarn inlet and the yarn outlet;

c. joining the alternating S/Z twisted yarns in phase after the yarn outlet, in which the short zones of the yarns approximately coincide and in which the zones of equal torsion of the yarns approximately coincide with each other;

d. connecting the coinciding short zones;

e. having the yarns self-twist thereby forming alternating S/Z twist plied yarns;

f. Removing the alternating S/Z twist plied yarns;

characterized in that the alternately application of S and Z torsion to the yarns in the chamber takes place according to a method for manipulating the yarns as described above, and also further in this document.

Specifically, it should be noted that the air jet devices in step a. of the above-mentioned method are air jet devices as described in the previous methods, and having a chamber, comprising a yarn inlet, a yarn outlet and preferably at least two air inlets, in which the previously described methods can be carried out. The at least two air inlets make it suitably possible to apply a S and Z torsion to the yarns by creating a tangential air flow (in which a first air inlet can create an air flow with a first rotation direction, and a second air inlet can create an air flow with a second rotation direction). However, it should be noted that the application of alternating S and Z torsion is also possible with an arrangement comprising only one air inlet. Indeed, a yarn with fixed positions (at a number of points at both sides of the air jet device, the yarn is fixed) aims for a total net torsion of 0, or at least a total present twist of 0. By intermittently applying a torsion (for example S torsion), the yarn will automatically achieve a desired equilibrium by providing the intermediate parts of the yarn (between zones with S torsion) with a substantially equal opposite torsion (Z torsion in this example) that neutralizes the applied S torsion.

Here, each of the yarns can be led through the chamber of the air jet device from the yarn inlet to the yarn outlet.

The invention also relates to an alternative method for fabricating alternating S/Z twist plied yarns, comprising the following steps:

a. separately introducing at least two yarns through a separate air jet device successively having a first chamber and a second chamber, in which the first chamber comprises a yarn inlet, and one or more air inlets, in which the second chamber comprises a yarn outlet, and one or more air inlets, in which the chambers are connected longitudinally with a chamber passage, and in which the one or more yarns are led through the chambers at the yarn inlet of the first chamber to the yarn outlet of the second chamber;

b. periodically applying S torsion to the yarns in the first chamber, in which zones of S torsion are alternated with torsion-free zones, and in which the S torsion is applied via a substantially tangential air flow around the yarns, in which the air flow is generated by introducing under an overpressure air in the first chamber via the one or more air inlets (for clarity, from the first chamber of the air jet device) through air inlet channels, in which the introduced air leaves the first chamber through the yarn inlet (of the first chamber) and the chamber passage (and thus the actual yarn outlet of the first chamber, that follows the actual yarn inlet of the second chamber);

c. periodically applying Z torsion to the yarns in the second chamber, in which zones of Z torsion alternate zones of S torsion with short zones in which approximately no twist is present between the Z torsion zones and the S torsion zones, and in which the Z torsion is applied via a substantially tangential air flow around the yarns with opposite rotation direction to the tangential air flow of the first chamber, in which the air flow of the second chamber is generated by introducing under an overpressure air in the second chamber via the one or more air inlets (of the second chamber of the air jet device) through air inlet channels, in which the introduced air leaves the yarn outlet (of the second chamber) and the chamber passage (and thus the actual yarn inlet of the first chamber);

d. joining the alternating S/Z twisted yarns in phase after the yarn outlet, in which the short zones of the yarns approximately coincide and in which the zones of equal torsion of the yarns approximately coincide with each other;

e. connecting the coinciding short zones;

f. having the yarns self-twist thereby forming alternating S/Z twist plied yarns;

g. removing the alternating S/Z twist plied yarns;

characterized in that the alternately application of S and Z torsion to the yarns in the chambers takes place according to a method for manipulating the yarns as described above, and also further in this document. For clarity, it relates to on the one hand alternately applying a S torsion to yarns in the first chamber by manipulating the yarns according to a method for manipulating yarns as described in the present document, and on the other hand alternately applying a Z torsion to the yarns in the second chamber by manipulating the yarns according to the method for manipulating yarns as described in the present document. Note that logically the S torsion in the second chamber could also be explained, and the Z torsion in the first chamber, with a small and logic adaptation of the air jet device.

Note that the first and second chamber as described in step a. of the method are chambers as described in the previous methods, thus comprising a yarn inlet and a yarn outlet, and one or more air inlets. The first and second chamber are connected by means of the chamber passage, that specifically connects the yarn outlet of the first chamber to the yarn inlet of the second chamber, as is indicated in the figures. Step a. specifically involves:

Separately introducing at least two yarns through a separate air jet device with a first chamber as described in the present document, and a second chamber similar to the first chamber, and also described in the present document, that follow each other, in which the first and second chamber are longitudinally connected to a chamber passage that connects the yarn outlet of the first chamber to the yarn inlet of the second chamber, and in which the yarns are led through the first and second chamber of the air jet device from the yarn inlet of the first chamber to the yarn outlet of the second chamber via the yarn outlet of the first chamber and the yarn inlet of the second chamber.

In an alternative version of the above-mentioned method, in step d., the alternating S/Z twisted yarns are joined in counter-phase, in which the zones with alternate torsion of the yarns approximately coincide with each other. In this version, step f. of having the yarns self-twist is not carried out, as the opposite torsions of the zones counteract each other. This method does not lead to alternately S/Z twist plied yarn, but to a connected alternating S/Z twisted yarn.

In a further embodiment, the invention relates to a method for fabricating a connected alternating S/Z twist plied yarn, and comprising the following steps:

a. fabricating at least two alternating S/Z twist plied yarns according to a method as described in the present document;
b. connecting the at least two alternating S/Z twist plied yarns for obtaining the connected alternating S/Z twist plied yarn, preferably according to a method for tacking one or more yarns as described in the present document.

In a third aspect, the invention relates to a method for fabricating alternating S/Z cabled yarns, and the method comprises the following steps:

a. separately introducing at least four yarns, divided over at least two groups of yarns, in which each yarn is led through first air jet devices with a chamber, in which the chamber comprises a yarn inlet, a yarn outlet and one or more air inlets, in which the one or more yarns are led through the chamber from the yarn inlet to the yarn outlet;
b. alternately applying S and Z torsion to the yarns in the first chambers, in which zones of S torsion are alternated by zones of Z torsion and vice versa, with in between short zones with approximately no twist, and in which the S and Z torsion is applied via a substantially tangential air flow around the yarns, in which the air flow is generated by introducing under an overpressure air in the chamber via the one or more air inlets, in which the introduced air leaves the chamber via the yarn inlet and the yarn outlet;
c. joining the alternating S/Z twisted yarns of the group in phase after the yarn outlet of the chambers, in which the short zones of the yarns of the group approximately coincide and in which the zones of equal torsion of the yarns of the group approximately coincide with each other;
d. connecting the coinciding short zones of the yarns of the group;
e. having the yarns of the group self-twist, thereby forming for each group an alternating S/Z twist plied yarn;
f. separately introducing the alternating S/Z twist plied yarns through second air jet devices, in which the second air jet devices comprise an inlet, an outlet and one or more air inlets, in which the one or more alternating S/Z twist plied yarns are led through the chamber of the second air jet device from the yarn inlet of the second air jet device to the yarn outlet of the second air jet device;
g. alternately applying a S and Z torsion to the alternating S/Z twist plied yarns, in a way to make overtwisted alternating S/Z twist plied yarns, in which short zones between zones with different torsion coincide with the original short zones of the alternating S/Z twist plied yarns, and in which the S and Z torsion is applied by providing an air flow, in which the air flow is generated by introducing under an overpressure air in the chamber of the second air jet device via the one or more air inlets of the second air jet device, in which the introduced air leaves the chamber of the second air jet device through the yarn inlet of the second air jet device and the yarn outlet of the second air jet device;
h. joining the overtwisted alternating S/Z twist plied yarns of the groups in phase, in which the short zones of the overtwisted alternating S/Z twist plied yarns approximately coincide, and in which the zones with equal torsion approximately coincide;
i. connecting the short zones of the overtwisted alternating S/Z twist plied yarns of the groups;
j. having the connected overtwisted alternating S/Z twist plied yarns self-twist, so that an alternating S/Z cabled yarn is formed;
k. removing the alternating S/Z cabled yarn;

characterized in that alternately applying the S and Z torsion to the yarns in the (chamber of the) first air jet devices is carried out (for clarity, by manipulating the yarns in the chamber of the first air jet devices) according to a method as described in the present document, and preferably further alternately applying the S and Z torsion to the alternating S/Z twist plied yarns in the (chamber of the) second air jet devices is carried out (for clarity, by manipulating the yarns in the chamber of the second air jet devices) according to a method above according to the present document.

It should be understood here that both the first air jet devices and the second air jet devices are such air jet devices as previously described in the methods of the present document, comprising a chamber comprising a yarn inlet, a yarn outlet and one or more air inlets.

Note that in step a. it is clear that each of the yarns is led separately (with a further possibility that 'each of the yarns separately' can also mean more yarns that are manipulated as one single yarn) through one of a number of air jet devices. It can for example be at 4 air jet devices, in which a first group of yarns is divided into two subgroups of yarns (with each subgroup having one or more yarns) that are lead per subgroup through one of the air jet devices. The same goes for the second group of yarns that are led through one of the other two air jet devices in two subgroups of one or more yarns.

Again, the chambers of the air jet devices (first and second) will typically be provided with at least two air inlets. Nevertheless, reference is made to a previous remark to indicated that the objective, providing one alternating S and Z torsion, can also be achieved with a single air inlet for a chamber of the air jet devices.

In an adapted version of the previous method, connected alternating S/Z twist plied yarns are produced as follows:

a. separately introducing at least four yarns, divided over at least two groups of yarns, in which each yarn is led through first air jet devices with a chamber, in which the chamber comprises a yarn inlet, a yarn outlet and one or more air inlets, in which the one or more yarns are led through the chamber from the yarn inlet to the yarn outlet;
b. alternately applying S and Z torsion to the yarns in the first chambers, in which zones of S torsion are alternated by zones of Z torsion and vice versa, with in between short zones with approximately no twist, and in which the S and Z torsion is applied via a substantially tangential air flow around the yarns, in which the air flow is generated by introducing under an overpressure air in the chamber via the one or more air inlets, in which the introduced air leaves the chamber via the yarn inlet and the yarn outlet;

c. joining the alternating S/Z twisted yarns of the group in phase after the yarn outlet of the chambers, in which the short zones of the yarns of the group approximately coincide and in which the zones of equal torsion of the yarns of the group approximately coincide with each other;

d. connecting the coinciding short zones of the yarns of the group;

e. having the yarns of the group self-twist thereby forming for each group an alternating S/Z twist plied yarn;

f. separately introducing the alternating S/Z twist plied yarns through second air jet devices, in which the second air jet devices comprise an inlet, an outlet and one or more air inlets, in which the one or more alternating S/Z twist plied yarns are led through the chamber of the second air jet device from the yarn inlet of the second air jet device to the yarn outlet of the second air jet device;

g. alternately applying a S and Z torsion to the alternating S/Z twist plied yarns, in a way to make overtwisted alternating S/Z twist plied yarns, in which short zones between zones with different torsion coincide with the original short zones of the alternating S/Z twist plied yarns, and in which the S and Z torsion is applied by providing an air flow, in which the air flow is generated by introducing under an overpressure air in the chamber of the second air jet device via the one or more air inlets of the second air jet device, in which the introduced air leaves the chamber of the second air jet device through the yarn inlet of the second air jet device and the yarn outlet of the second air jet device;

h. joining the overtwisted alternating S/Z twist plied yarns of the groups in counter-phase, in which the short zones of the overtwisted alternating S/Z twist plied yarns approximately coincide, and in which the zones with opposite torsion approximately coincide;

i. connecting the short zones of the overtwisted alternating S/Z twist plied yarns of the groups so that a connected alternating S/Z twist plied yarn is obtained;

j. removing the connected alternating S/Z twist plied yarn;

characterized in that alternately applying the S and Z torsion to the yarns in the (chamber of the) first air jet devices is carried out according to a method above (for clarity, by manipulating the yarns in the chamber of the first air jet devices) as described in the present document, and preferably further alternately applying the S and Z torsion to the alternating S/Z twist plied yarns in the (chamber of the) second air jet devices is carried out according to a method above (for clarity, by manipulating the yarns in the chamber of the second air jet devices) according to the present document.

It should be understood here that both the first air jet devices and the second air jet devices are such air jet devices as previously described in the methods of the present document, comprising a chamber comprising a yarn inlet, a yarn outlet and one or more air inlets.

Note that in step a. it is clear that each of the yarns is led separately (with a further possibility that 'each of the yarns separately' can also mean more yarns that are manipulated as one single yarn) through one of a number of air jet devices. It can for example be at 4 air jet devices, in which a first group of yarns is divided into two subgroups of yarns (with each subgroup having one or more yarns) that are lead per subgroup through one of the air jet devices. The same goes for the second group of yarns that are led through one of the other two air jet devices in two subgroups of one or more yarns.

Again, the chambers of the air jet devices (first and second) will typically be provided with at least two air inlets. Nevertheless, reference is made to a previous remark to indicated that the objective, providing one alternating S and Z torsion, can also be achieved with a single air inlet for a chamber of the air jet devices.

Normally, torsion (or twist) is applied to a yarn by leading the yarn through a first part of an air jet device, namely a twisted jet, in which an air flow is generated by an overpressure in a chamber through which the yarn is pulled. The air flow is tangential and applies torsion or twist to the yarn. In this respect, the applicant has noted that the amount of torsion that is applied per length unit to a yarn, dependent on the local torsion of the yarn. Here, it is referred to the torsion that is present on the yarn that is located further and/or earlier in the twist jet or out there. In this way, it is possible that a length unit of the yarn shortly after a torsion-free short zone is twisted more strongly than a length unit of the yarn further after the short zone, because torsion that is already present on further zones of the yarn more shortly after the short zone, attenuates the application of torsion on the length unit further after the torsion-free short zone. In this way, an unequal amount of torsion is applied over the length of the yarn, with in particular a (periodically returning) unequal twist between two successive short zones substantially without twist or torsion. As said, the applicant has noted that the amount of twist that is applied per length unit to a yarn, seems to depend on the local torsion in the yarn. Moreover, the applicant has noted that the value of the overpressure, at which the air flow is generated, has an influence on the amount of torsion that is applied to a yarn with a particular local torsion. By obtaining a critical flow at the outlets of the chamber, it is possible to create an overpressure in the chamber itself. By combining these two conclusions, a yarn with an equal torsion can be produced, which will improve the uniform aspect of the final product, as well as the quality by a better tacking.

The invention of the applicant solves the problem by carrying out the intertwining of the yarns in the twisting directions under a varying overpressure at which the air flow is generated. The varying overpressure will preferably follow a substantially periodic profile. When intertwining for producing alternating S/Z twist plied yarns, alternating S/Z bunched yarns are produced as an intermediate step. The alternating S/Z bunched yarns have successive alternating zones of S torsion and Z torsion, separated by torsion-free short zones in which the rotation direction of the applied torsion changes and where substantially no torsion is present. Further, the varying overpressure preferably follow a substantially periodic profile with as a period a period of time between the creation of a torsion-free short zone in the yarn to the creation of a successive torsion-free shot zone of the yarn in the twisting direction. This period of time can be set by an operator. Still more preferably, the profile of the evolution of one period is a rising period. The profile can further be stepped, but it can also be a polynomial function, or combinations. It can one the one hand be expected that a fixed profile for the varying overpressure can be provided that can solve the above-mentioned problems, as the problem will appear periodically under substantially identical conditions. However, it is advisable that small variations can still be compensated. Therefore, still more preferably, the profile of the varying overpressure can be adapted to information about the torsion of the bunched yarn, such as the local torsion. In this way, corrections can be made more quickly at variations and an even more uniform torsion can be applied. By carrying out the method with increasing profile for the overpressure, it is moreover possible to carry out the process, whether or not partially, at much lower overpressures than normally (9 bar and higher) sued in such methods. This saves much energy, as maintaining such high overpressures consumes very much energy.

The same principle can be followed for the cabling device, where an overtwist jet has the same functionality as the twist jet that is described above. Again, it is advisable that the overtwist jet provides a (tangential) air flow for applying torsion to the alternating S/Z twist plied yarns that are manipulated in the overtwist jet. The air flow is provided by means of a varying overpressure for similar reasons as for the twist jet, with the same preferences as described earlier. The overpressure can again be controlled and preferably follows a substantially periodic profile, with again as a period the period of time between the creation of two successive torsion-free short zones in the overtwist jet. The profile is within one period preferably a rising function, for example stepped, polynomial or combinations. Still more preferably, the profile can be adapted by means of data, such as the local torsion of the yarn in the overtwist jet.

For example, the following method for applying a torsion to a yarn can be described, comprising the following steps:

a. introducing the yarn through an air jet device with a chamber, in which the chamber comprises a yarn inlet, a yarn outlet and one or more air inlets, in which the yarn is led through the chambers from the yarn inlet to the yarn outlet;
b. applying the torsion to the yarn in the chamber, in which the torsion is applied via a substantially tangential air flow around the yarn, in which the air flow is generated by introducing under an overpressure air in the chamber via the one or more air inlets via air inlet channels, in which the introduced air leaves the chamber via the yarn inlet and the yarn outlet;

characterized in that the overpressure at which the air is introduced, rises periodically so that the applied torsion is substantially equal. It should also be taken into account that, as said earlier, said method can be used combined with methods for manipulating yarn by applying a torsion as described earlier and further in the present document. Alternatively, said maid can also be combined with said methods for tacking yarns reciprocally.

The system according to the invention is in a preferred embodiment arranged for carrying out the steps in the paragraphs above. The system can comprise one or more twist jets and/or one or more overtwist jets suitable for generating a (tangential) air flow in a chamber of the twist jet through which yarn is led, in which the air flow is generated by introducing air at an overpressure. The system is adapted so that the provided overpressure at the twist jet can be varied, preferably according to a profile as described in the paragraphs above. Preferably, the overpressure can be regulated by means of a control unit based on data from a torsion-measuring element shortly after the twist jet. The control unit can operate either correctively or by adjusting the profile of the overpressure.

In a fourth aspect, the invention relates to an air jet device for manipulating one or more yarns through an air flow, comprising:

a. a longitudinally extending chamber comprising:
   i. one or more side walls;
   ii. a yarn inlet at a first longitudinal end of the chamber, in which the yarn inlet has a cross-section;
   iii. a yarn outlet at a second longitudinal end of the chamber, in which the yarn outlet has a cross-section, in which the first and the second longitudinal end are located oppositely;
   iv. and one or more air inlets;
b. one or more air inlet channels creating an air flow and ending in the side wall (or side walls) of the chamber, in which the air inlet channels have a cross-section and the air inlet channels are oriented so that the air inlet channels are suitable for generating an air flow in the chamber;

characterized in that the ratio of the cross-section of the yarn outlet of the chamber to the cross-section of the air inlet channels for generating the air flow is such that a critical air flow can be provided at the yarn outlet of the chamber when a predetermined overpressure is applied at the air inlets, and in which preferably, a critical air flow can also be provided at the yarn inlet of the chamber when the predetermined overpressure is applied to the air inlets.

Here, it should be noted that it is evident that the one or more air inlet channels can end in one of the side walls, but also, in case of more air inlet channels, distributed over more of the side walls of the chamber.

In this respect, the applicant has noted that for a suitable choice of the ratio, a desired overpressure in the chamber is obtained as a result of which shock waves are avoided at the expansion of the air flow out of the air inlet channels in the chamber. The shock waves cause big energy losses as they are not controlled, and the air flow in the chamber preferably must be generated as controlled as possible. Moreover, a shock wave can disturb an existing, desired air flow in the chamber. Furthermore, the desired overpressure also causes an increased air mass density, which increases the interaction of parts in the air flow with the filaments, and ensures in this way that the air flow can apply more simple and efficient desired manipulations to the one or more yarns.

In a further embodiment, it relates to an air jet device for alternately applying an S and Z torsion, respectively, in a yarn for obtaining a S/Z twisted yarn and for applying a false-twist in a yarn for obtaining a false-twisted yarn, in which the air jet device comprises the following elements:

a. a longitudinally extending chamber comprising:
   i. one or more side walls;
   ii. a yarn inlet at a first longitudinal end of the chamber, in which the yarn inlet has a cross-section;
   iii. a yarn outlet at a second longitudinal end of the chamber, in which the yarn outlet has a cross-section, in which the first and the second longitudinal end are located oppositely;
   iv. and one or more air inlets;
b. one or more air inlet channels creating an air flow and ending in the side walls of the chamber, in which the air inlet channels have a cross-section and the air inlet channels are oriented so that the air inlet channels are suitable for generating a substantially tangential air flow in the chamber, in which the substantial tangential air flow is suitable for applying the torsion or the twist to the yarn;

characterized in that the ratio of the cross-section of the yarn outlet to the cross-section of the air inlet channels for generating the air flow is such that a critical air flow can be provided at the yarn outlet of the chamber when a predetermined overpressure is applied at the air inlets.

Here, it should be noted again that often, two air inlet channels generating an air flow will be provided (or at least two air inlets thereto in the side walls of the chamber), although theoretically speaking, it is not necessary. In this respect, reference is made to earlier arguments. Again, it should be understood that the air inlet channels can end in one side wall, but can also be distributed over more side walls if more air inlet channels are provided.

Alternatively, the invention provides an air jet device according to the same principle, for alternately applying an S and Z torsion, respectively, in a yarn for obtaining a S/Z twisted yarn and for applying a false-twist in a yarn for obtaining a false-twisted yarn, and in which the air jet device comprises the following elements:

a. a longitudinally extending first chamber comprising:
   i. one or more side walls;
   ii. a yarn inlet at a first longitudinal end of the first chamber, in which the yarn inlet has a cross-section;
   iii. and one or more air inlets;
b. a second chamber extending longitudinally after the first chamber, comprising:
   i. one or more side walls;
   ii. a yarn outlet at a distal end of the second chamber with respect to the first chamber, in which the yarn inlet has a cross-section;
   iii. and one or more air inlets;
c. a chamber passage that connects a proximal end of the first chamber with respect to the second chamber with a proximal end of the second chamber with respect to the first chamber, in which the first and the second longitudinal end are located opposite to each other, in which the chamber passage has a cross-section;
d. one or more air inlet channels creating an air flow and ending in the side wall(s) of the first chamber, in which the air inlet channels have a cross-section and the air inlet channels are oriented so that the air inlet channels are suitable for generating a substantially tangential air flow in the first chamber, in which the substantial tangential air flow is suitable for applying the torsion or the twist to the yarn;
e. one or more air inlet channels creating an air flow and ending in the side wall(s) of the second chamber, in which the air inlet channels have a cross-section and the air inlet channels are oriented so that the air inlet channels are suitable for generating a substantially tangential air flow in the second chamber, in which the substantial tangential air flow is suitable for applying the torsion or the twist to the yarn and in which the substantial tangential air flow has an opposite rotation direction with respect to the substantial tangential air flow of the first chamber;

characterized in that the ratio of the cross-section of the yarn outlet to the cross-section of the air inlet channels for generating the air flow is such that a critical air flow can be provided at the yarn outlet, and preferably also at the chamber passage, when a predetermined overpressure is applied at the air inlets. Still more preferably, under these conditions, a critical air flow is also provided at the yarn inlet.

Specifically, the description above should be understood as that the ratio of the cross-section at the yarn outlet of the second chamber to the cross-section of the air inlet channels at the second chamber for generating the air flow is such that a critical air flow can be provided at the yarn outlet of the second chamber when a predetermined overpressure is applied to the air inlets of the second chamber, and preferably, in which the ratio of the cross-section of the chamber passage to the cross-sections of the air inlet channels at the first chamber for generating the air flow is such that a critical air flow can be provided at the chamber passage, when a predetermined overpressure is applied to the air inlets of the first chamber. Note that generating a critical air flow at the chamber passage means generating a critical air flow at a theoretical yarn outlet of the first chamber and a theoretical yarn inlet of the second chamber. Still more preferably, under these conditions, a critical air flow is also provided at the yarn inlet of the first chamber.

For clarity reasons, it should thus be noted that both chambers (first and second chamber) can dispose of a yarn inlet and a yarn outlet, next to the one or more side walls and the one or more air inlets. The yarn outlet of the first chamber (at the second longitudinal end of the first chamber) is included in the chamber passage, as well as the yarn inlet of the second chamber (at the distal end of the second chamber with respect to the first chamber), as will be clear from the respective figure. In this way, said air jet device can be interpreted logically in line with further aspects and embodiments of the present document.

Again, it should be understood that the air inlet channels can end in (air inlets of) one single side wall of the chambers (first and/or second) of can be distributed over more of the side walls if several air inlet channels are present.

The device described here, differs from the above-mentioned device because it comprises two successive chambers in which a substantial tangential air flow is generated, and in which these air flows have an opposite rotation direction. Said air jet device carries out this process in one single chamber by periodically alternating the rotation direction of the tangential air flow. In this way, it is possible to apply zones with S torsion to the yarn in the first chamber, and zones with Z torsion to the yarn in the second chamber. Both the described air jet devices with one chamber and two chambers are basis on the same improvement, and are some other application forms of the same invention. All other possible improvements described in the present document that can be applied to the air jet device with one single chamber, can, subject to a simple adjustment, also be applied to the air jet device with two successive chambers.

Alternatively, the air jet device can be used on already twist plied yarns instead of separate yarns, and can in this way be used as cabling device instead of twisting device.

In a preferred embodiment, the air jet device is suitable for alternately applying an S and Z torsion, respectively, in a yarn for obtaining a S/Z twisted yarn or alternatively, applying a false-twist in a yarn for obtaining a false-twisted yarn. In this respect, the air inlet channels are oriented such that they are suitable for generating a substantially tangential air flow in the chamber, in which the substantially tangential air flow is suitable for applying the torsion or twist to the yarn, and characterized in that the ratio of the cross-section of the yarn outlet of the chamber to the cross-section of the air inlet channels for generating the air flow is such that a critical air flow can be provided at the yarn outlet of the chamber when a predetermined overpressure is applied at the air inlets, and in which preferably, a critical air flow can also be provided at the yarn inlet of the chamber when the predetermined overpressure is applied to the air inlets.

In this respect, the applicant has noted that at an suitable choice of the ratio, a desired overpressure in the chamber can be achieved, that, next to the above-mentioned advantages of avoiding shock waves and the increased air mass density, can also ensure that tangential air flow is maintained longer, while the tangential air flow in known systems more quickly changes into an axial air flow.

In a further embodiment, the air jet device is characterized in that the ratio of the cross-section of the yarn inlet to the cross-section of the air inlet channels for generating the air flow, is adapted so as to provide a critical air flow at the yarn outlet at a predetermined range of mass flow rate of the air inlet channels, and considering a known range of diameters of the yarn that extends centrally along the longitudinal direction of the chamber through the yarn inlet and the yarn outlet, and at a predetermined rang of overpressure at the air inlets.

In a further embodiment, the air jet device is characterized in that the ratio of the cross-section of the yarn outlet to the cross-sections of the air inlet channels for generating the air flow, considering that the yarn with a known diameter extends centrally along the longitudinal direction of the chamber through the yarn inlet and through the yarn outlet, is such that a critical air flow is provided at the yarn outlet at a predetermined rang of overpressures at the air inlets and eventually at a predetermined range of air densities in the chamber.

In a further embodiment, the air jet device is characterized in that the ratio of the cross-section of the yarn inlet to the cross-sections of the air inlet channels for generating the air flow, and considering that the yarn with a known diameter extends centrally along the longitudinal direction of the chamber through the yarn inlet and through the yarn outlet, is such that a critical air flow is provided at the yarn inlet. Preferably, the air flows at the yarn inlet and at the yarn outlet are such that the yarn is pushed inside at the yarn outlet through a concentric pressure gradient at the yarn inlet.

In a further embodiment, said predetermined overpressure at the air inlets is between 1 bar and 7 bar, preferably between 2 bar and 5 bar, and more preferably about 3 bar. Specifically, the air jet device is configured in such way that the critical air flow can be provided at the yarn outlet at said predetermined overpressure between 1 bar and 7 bar, preferably between 2 bar and 5 bar, and more preferably about 3 bar.

In a further embodiment, the air jet device further comprises:

a. a narrow channel that extends from the yarn outlet of the chamber with substantially the same cross-section as the yarn outlet, in the same longitudinal direction of the chamber;

b. a second chamber that extends in the same longitudinal direction of the chamber, with one or more side walls, a yarn inlet at a first longitudinal end of the second chamber in which the narrow channels ends in the yarn inlet of the second chamber, and a yarn outlet at a second longitudinal end of the second chamber, and in which the first and the second longitudinal end of the chamber are located oppositely;

in which the yarn further extends centrally through the narrow channel, through the second chamber and through the yarn outlet of the second chamber, characterized in that the second chamber has a cross-section and the narrow channel has a cross-section in which the ratio of the cross-section of the second chamber to the cross-section of the narrow channel are such that the air flow at the yarn outlet and/or the yarn inlet of the second chamber is a critical air flow.

In a further embodiment, the yarn outlet has a cross-section, and the one or more air inlet channels have cross-sections, characterized in that the ratio of the cross-section of the yarn outlet to the cross-section of the air inlet channels generating the air flow, is between 1.5 and 8, preferably between 2 and 6. Possibly, the range of this ratio can have higher and/or lower extreme values, for example between 1 and 10, or more precisely, such as 2.5, 3.5, 4, 4.5, 5, 5.5, 6, 6.5, 7 and/or 7.5.

In a further embodiment, the air jet device is characterized in that the chamber narrows towards the longitudinal ends in a continuous and/or stepped manner. Thus, it is possible that the chamber narrows towards the longitudinal ends according to a combination of different continuous and/or stepped zones, as will be clear from a number of figures.

In a further embodiment, the cross-section of the chamber is between 12 $mm^2$ and 60 $mm^2$, and the cross-section of the yarn outlet is between 1 $mm^2$ and 10 $mm^2$, and the cumulative cross-section of the air inlet channels for generating the air flow is between 0.2 $mm^2$ and 2.5 $mm^2$, and the cross-section of the yarn inlet is preferably between 1 $mm^2$ and 10 $mm^2$. Specifically, the air jet device is configured in such way that the critical air flow can be provided at the yarn outlet at the cross-section of the chamber between 12 $mm^2$ and 60 $mm^2$, and the cross-section of the yarn outlet between 1 $mm^2$ and 10 $mm^2$, and the cumulative cross-section of the air inlet channels for generating the air flow between 0.2 $mm^2$ and 2.5 $mm^2$, and the cross-section of the yarn inlet preferably between 1 $mm^2$ and 10 $mm^2$. In this respect, it should be understood that the yarn inlet, yarn outlet, air inlet channels are these of the respective chamber.

In a further embodiment, the known diameter of the yarn is between 0.2 mm and 5 mm, preferably between 0.4 mm and 2.5 mm.

In an alternative embodiment, the method is adapted for tacking the two or more yarns by providing an air flow that is suitable for tacking the two or more yarns. This is also referred to as a tacking device. Practically, a radial air flow will be provided in the chamber (to interpret as an air flow crossing the longitudinal axis of the chamber), radially with respect to the longitudinal axis of the tacking device, along which the yarns are led. This radial air flow is split into two separate, substantially parallel vortex air flows with opposite rotation direction, that can tack filaments of the two or more yarns.

In an alternative embodiment, the method is adapted for false-twisting a yarn by providing an air flow that is suitable for applying a false-twist to the yarn. The process of false-twisting a yarn or applying a false-twist to a yarn has already been described thoroughly in literature, such as for example U.S. Pat. No. 4,122,658. This process will not be further explained, unless necessary for understanding the invention, since the invention can be applied to any possible variations of the process. The applicant noted that the advantages of the invention also apply to methods for false-twisting yarn, since also there, at high pressures, tangential air flows are used for applying torsion to one or more yarns.

In a fifth aspect, the invention relates to a system for fabricating alternating S/Z twist plied yarns, and the device comprises:

a. an introducing member for separately introducing at least two individual yarns;

b. a member for tensioning every yarn;

c. at least one air jet device, preferably two air jet devices, for alternately applying a, respectively, S and Z torsion in at least one of the individual yarns, for obtaining at least one S/Z twisted yarn, preferably two S/Z twisted yarns, in which short zones without net twist separate zones with S torsion of the yarn and zones with Z torsion of the yarn;

d. a fixation member for joining the alternating S/Z twisted yarns, and for connecting the alternating S/Z twisted yarns at the place of the short zones, thereby obtaining the alternating S/Z twist plied yarns;

e. a control member for combining all said members in a coordinated way;

characterized in that at least one of the air jet devices, and preferably all the air jet devices, is an air jet device as described in the present document.

Again, it should be noted that in step c. typically at least two air jet devices will be provided for manipulating at least two yarns (at least one per air jet device), so that in this way, at least two S/Z twisted yarns can be obtained.

In a sixth aspect, the invention relates to a system for fabricating alternating S/Z cable yarns or a connected alternating S/Z twist plied yarn, comprising:

a. at least two systems for fabricating alternating S/Z twist plied yarns, in which the systems are adapted to work in parallel;

b. at least one second air jet device, preferably two air jet devices, for alternately applying a, respectively, S and Z torsion in at least one or the separate alternating S/Z twist plied yarns, preferably in two of the separate alternating S/Z twist plied yarns, for obtaining at least one overtwisted alternating S/Z twist plied yarn, preferably two overtwisted alternating S/Z twist plied yarns, in which short zones approximately without net twist separate zones with S torsion of the alternating S/Z twisted twist plied and zones with Z torsion of the alternating S/Z twist plied yarns, and in which the short zones of the overtwisted alternating S/Z twist plied yarns coincide with the original short zones of the alternating S/Z twist plied yarns;

c. at least one introducing member for introducing the alternating S/Z twist plied yarns of the systems for fabricating alternating S/Z twist plied yarns to the at least one second air jet device;

d. a second fixation member for joining the overtwisted alternating S/Z twist plied yarns, and for connecting the overtwisted alternating S/Z twist plied yarns at the place of the short zones, for obtaining the alternating S/Z cables yarn or the connected alternating S/Z twist plied yarn;

characterized in that at least one of the devices for fabricating alternating S/Z twist plied yarn or connected alternating S/Z twist plied yarn is a system for fabricating alternating S/Z twist plied yarns as described in the present document. Again, it should be taken into account that in step b. typically (at least) two air jet devices will be present for alternately applying a respectively S and Z torsion in the separate alternating S/Z twist plied yarns (thus typically at least two) for obtaining (thus typically at least two) overtwisted alternating S/Z twist plied yarns.

In a further embodiment, the system for fabricating an alternating S/Z cabled yarn or a connected alternating S/Z twist plied yarn is characterized in that at least one of the two air jet devices is an air jet device as described in the present document.

In a seventh aspect, the invention relates to a manipulated yarn fabricated according to a method as described in the present document.

In an eighth aspect, the invention relates to an alternating S/Z cabled yarn or a connected alternating S/Z twist plied yarn fabricated according to a method as described in the present document.

DESCRIPTION OF THE FIGURES

FIG. 5B shows a longitudinal cross-section perpendicular parallel to the air inlet channel, FIG. 5C shows a longitudinal cross-section perpendicular to the air inlet channel.

DETAILED DESCRIPTION

Figure 1A:
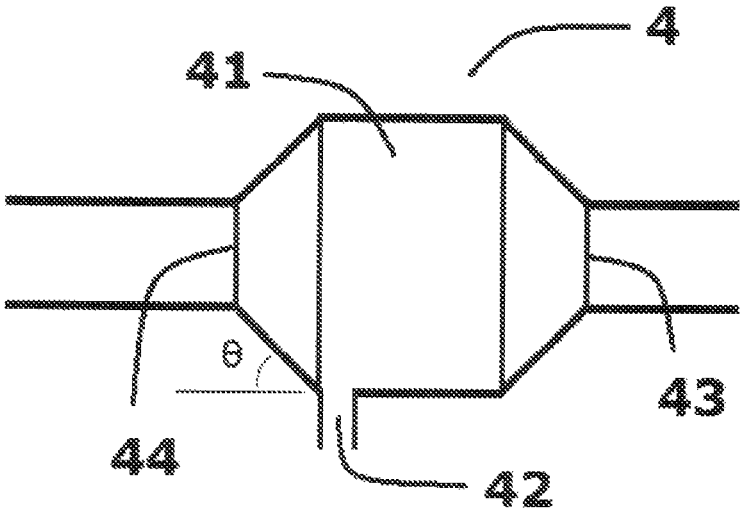
FIG. 1A-E shows longitudinal cross-sections of a chamber for an air jet device according to the invention.

Unless otherwise specified, all terms used in the description of the invention, including technical and scientific terms, shall have the meaning as they are generally understood by the worker in the technical field of the invention. For a better understanding of the description of the invention, the following terms are explained specifically.

"A", "an" and "the" refer in this document to both the singular and the plural unless otherwise specified by the context. For example, "a segment" means one or more than one segment.

When "approximately" or "about" are used in the document together with a measurable quantity, a parameter, a period or moment, etc., variations of +/−20% or less, preferably +/−10% or less, more preferably +/−5% or less, still more preferably +/−1% or less, and even still more preferably +/−0.1% or less than and of the cited value are meant, as far as such variations apply to the invention that is described. It will however be clearly understood that the value of the quantity at which the term "approximately" or "about" is used, is itself specified.

The term "include", "including", "consist of", "consisting of", "provide with", "comprise", "comprising", "involve", "involving" are synonyms and are inclusive of open terms that indicate the presence of what follows, and that do not exclude or prevent the presence of other components, characteristics, elements, members, steps, known from or described in the state of the art.

The term "yarn" refers to a spun thread, in this case comprising several filaments, of BCF yarns (bulked continuous filament). The individual yarns typically have a diameter between 0.2 mm and 2 mm, the already twist plied yarns have a larger diameter, between 0.5 mm and 5 mm, dependent on the circumstances. In this respect, it should be noted that BCF yarn is compressible and that therefore, the diameter or thickness of the yarn is indicated preferably by means of yarn numbers, as the ratio of the mass and length of a piece of yarn. Practically, for individual yarns, this means a range between 250 dtex and 4000 dtex, and for twist plied yarns, a range between 2000 dtex and 10000 dtex. Smaller ranges are possible, for example 600 dtex to 2000 dtex for individual yarns, and 2000 dtex to 5000 dtex for twist plied yarns, but this is however not limiting the applicability of the invention.

The term "choked flow" or "critical flow", more specifically with respect to air flows, refers to circumstances in which an, in this case, air flow flows through a narrowing to a zone with a lower pressure. In this case, the flow rate increases as the differential pressure before and after the narrowing increases, relatively and/or absolutely. Critical flow is reached at a moment at which the flow rate of the air flow does not further increase at a larger differential pressure before and after the narrowing. There reason therefore is that the flow rate of the air flow is limited to the local sound velocity. When the flow rate of the air flow through the narrowing is too high, the flow becomes supersonic and turbulence and other effects are generated involving energy losses, and moreover decreasing the effective mass flow rate. In practice, the generation of a critical flow also leads to shock waves further downflow. A way to detect the critical flow at the outlet of the air jet device is thus to observe any possible shock waves. This can be done by means of Schlieren photography. Schlieren photography is generally used for studying the flow of fluids, and in particular for studying the flow around and higher than the sound velocity. The technique itself is well-known and will not be further discussed in the present document, unless necessary for understanding the invention. Schlieren photography can also be used for mapping shock waves after the yarn outlet. Obviously, this also applies to shock waves at the yarn inlet, where a critical flow can exist.

The term "overpressure" at air inlets refers to the differential pressure between the pressure at the air inlets and the pressure after the outlet of the chamber, in which a positive overpressure indicates a higher pressure at the air inlets than the pressure after the outlet of the chamber. In other words, it is the overpressure of the air that is introduced in the chamber via the air inlets.

The term "overpressure" of the chamber refers to the differential pressure between the chamber and the yarn inlet and/or yarn outlet.

The terms "twist plying" and "twist plied" refers to the procedure, or a characteristic of the product thereof, in which one or more yarns are intertwined with another set of one or more yarns.

The term "twist" and "twisted" refers to the procedure, or a characteristic of the product thereof, in which torsion is applied to a yarn, leading to a deformation in which the energy of the torsion is stored in the yarn, and visually leads to a twisted yarn.

The term "tack" or "tacking" refers to the connection of more separate yarns, or more separate, twist plied yarns, in which the yarns comprise several filaments. When tacking, the yarns are connected by intertwining some of these filaments with each other over a limited length, for example by bringing the separate yarns close to each other and subsequently applying an air flow pulse, thus leading to the intertwining of the filaments via air vortexes.

The term "cabled" refers to a product that is obtained by twisting two or more already twist plied yarns.

The term "connected alternating S/Z twist plied yarns" refers to a yarn that is fabricated by in counter-phase joining alternating S/Z twist plied yarns, and connecting these in the torsion-free short zones. Here, there is no self-twist as the connected yarns have an opposite torsion. The opposite torsions compensate each other and present de-torsioning of the yarns.

The term "alternating S/Z twisted" and "alternating S and Z twisted" refer to the condition of a yarn onto which a spatially alternate torsion has been applied.

The terms "alternating S and Z twisted" and "alternating S/Z twisted" refer to yarns that have been twisted with each other as a result of applying an alternate S/Z torsion to the yarns and subsequently self-twisting the yarns with each other.

The inventions described in the present document, both methods, air jet devices and covering devices, and the products fabricated according to the methods all have different advantages with respect to the state of the art related to the present subject. As said, very high volumes of yarns are produced with these systems, at very high speeds. In order to fabricate a high-quality product, the application of sufficient torsion, that is applied in an equal and controlled way, is crucial. This process is carried out in the devices according to the state of the art at very high overpressures in the devices, of about 8 bar or higher. Maintaining this overpressure requires a lot of energy, and is thus very expensive. Moreover, this overpressure is maintained by system especially developed therefore that, in order to be able to generate higher pressure, are also more complex, more fragile and more expensive. By obtaining a critical flow at the yarn outlet, a more efficient energy consumption is moreover also achieved, without the losses due to turbulences and other undesired flow effects that occurs at a supercritical air flow, a problem that occurs at the old known systems and methods. In order to avoid supercritical flows without maintaining the overpressure therefore excessively high, the energy consumption when using the devices and/or methods of the present document is further reduced, and also the yarn feed is stabilized.

When determining the dimensions of the chamber, air inlet channels, yarn outlet, yarn inlet, air inlet and other elements, one should take into account the fact that they are adjustable to the operational parameters, the yarn thickness and other factors, while the adjustments of the dimensions do not change the principle onto which the invention is based, namely the provision of a critical air flow at the yarn outlet and/or the yarn inlet. The dimensions referred to in this document are conventional dimensions, but do not limit the applicability of the present invention.

In a preferred embodiment, the cross-section of the chamber is for example between 12 $mm^2$ and 60 $mm^2$, but it can also have higher and/or lower external limits, for example 5 $mm^2$ and/or 100 $mm^2$, or it can be smaller, for example between 20 $mm^2$ and/or 40 mm, such as 25 $mm^2$, 30 $mm^2$ and/or 35 $mm^2$. Moreover, the cross-section of the yarn outlet is between 1 $mm^2$ and 10 $mm^2$, but it can also have higher and/or lower external limits, for example 0.5 $mm^2$ and/or 20 $mm^2$, or it can be smaller, for example between 2 $mm^2$ and/or 7 $mm^2$, 3 $mm^2$, 4 $mm^2$, 5 $mm^2$ and/or 6 $mm^2$ as upper or lower limit. The cumulative cross-section of the air inlet channels for generating the air flow is for example between 0.2 $mm^2$ and 2.5 $mm^2$, but it can also have higher and/or lower external limits, for example 0.1 $mm^2$ and/or 5 $mm^2$, or it can be smaller, for example between 0.5 $mm^2$ and/or 1.5 $mm^2$. Moreover, the cross-section of the yarn inlet is preferably between 1 $mm^2$ and 10 $mm^2$, such as 2 $mm^2$, 3 $mm^2$, 4 $mm^2$, 5 $mm^2$, 6 $mm^2$, 7 $mm^2$, 8 $mm^2$ and/or 9 $mm^2$, but it can also have higher and/or lower external limits, for example 0.5 $mm^2$ and/or 20 $mm^2$, or it can be smaller, for example between 2 $mm^2$ and/or 7 $mm^2$, or 3 $mm^2$, 4 $mm^2$, 5 $mm^2$ and/or 6 $mm^2$.

The length of the chamber, that is the shortest distance between the yarn inlet and the yarn outlet, is between 2 mm and 40 mm, preferably between 5 mm and 30 mm, such as 6 mm, 8 mm, 10 mm, 12 mm, 14 mm, 16 mm, 18 mm, 20 mm, 22 mm, 24 mm, 26 mm and/or 28 mm, although these dimensions depend on the yarn thickness and other parameters.

The passage of the air inlet channels to the chamber (via the air inlets) in each plane is described by means of functions. In a preferred embodiment, the air inlets and/or the air inlet channels and/or the chamber can be adjusted so that these functions have a third derivative that is a continuous function, in order to ensure an optimal passage of the air flow out of the air inlet channels to the chamber.

In a preferred embodiment, the air inlet channels have a length that is at least equal to the diameter of the air inlet channels in order to be able to generate a uniform air flow at the air inlet to the chamber, to avoid turbulence (energy loss) and/or to avoid an undesired Laval nozzle in the air flow. The length is preferably between 1 and 10 times the diameter of the air inlet channels. Preferably, it is between 1 and 5 times. Practically, a length between 1 and 1.5 times the diameter of the air inlet channels is suitable. In this way, an all too big pressure loss can be avoided over the air inlet channels.

In a possible embodiment for the chambers of an air jet device, the chambers have two air flow channels generating an air flow that end in the air inlets of the side wall of the chamber, adjacent to the yarn inlet of the chamber. The two air inlet channels are oriented in such way that a first air inlet channel is suitable for supplying the airflow for applying an S torsion, and a second air inlet channel for supplying the air flow for applying a Z torsion. Preferably, the air inlet channels are positioned closer to the yarn inlet than to the yarn outlet.

The air inlet channels can have a circular, oval, square, rectangular, triangular, polygonal, polygonal rounded or other cross-section, as well as combinations of two or more of the above-mentioned forms, or they can have cross-section that narrow or broaden, adjusted to an optimal passage of the air flow in the air inlet channels to the chamber. At an air jet device for applying a torsion to yarn, the air inlet preferably has the form of a rectangle so as to allow the air flow to be as tangential as possible in the chamber. This ensures that the supersonic expansion of the air flow does not touch the yarn. The rectangle must be oriented in such way that the long side of the rectangle are tangential to the chamber, because in this way, the tangential air flow could transfer sufficient torsion to the yarn. However, the shorter the short side, the higher the pressure drop and friction losses. Therefore, an equilibrium must be found between the length of the long sides and the short sides. An air inlet that is too small, can for example cause higher hydraulic losses. Alternatively, one can also choose an oblate as the cross-section of the air inlet, with similar orientation for the same reasons.

In a preferred embodiment for the methods and the air jet device, a subsonic air flow is generated at the outlet, and preferably also at the inlet, of the chamber. The subsonic air flows can be generated by adjusting structural parameters of the chamber, such as the cross-sections of the yarn inlet and/or of the yarn outlet and/or of the chamber and/or of air inlet channels and/or environmental parameters, such as overpressure at the air inlets and/or mass flow rate of the air inlet channels and/or diameter of the yarn and/or other. Note that the critical air flow (or critical air flows) still occur at the yarn outlet and/or yarn inlet of the chamber, but mostly not in the rest of the air jet device. In this respect, 'outlet' must also be understood as the part preceding the yarn outlet of a chamber, and 'inlet' as the part following the inlet of the yarn inlet of a chamber. In these zones, it is thus more interesting to work under said subsonic air flows.

In a preferred embodiment, the chamber is at least partially cylindrical. However, the chamber can also be elliptic-cylindrical or it can have any other form, or a combination of more parts. Preferably, the cross-section of the chamber narrows towards the yarn outlet and/or towards the yarn inlet in a continuous and/or stepped manner. Alternatively, it can thus also narrow down in a phased way, as said, thus combinations of different continuous and/or stepped parts. The form of the chamber will be further discussed in the examples.

The number of steps occurring in the stepped narrowing is between 1 and 10, preferably between 1 and 5 and more preferably 2 or 3. Moreover, the steps can bevel to a next 'step', in order to ensure a smooth transition, which is advantageous for preventing local turbulence. These bevelled steps can occur in an angle of 15° to just below 90°. Preferably, it lies between 45° and 70°, more preferably it is about 60°.

At a continuous narrowing, the narrowing can also bevel with respect to a central zone of the chamber with angles between 15° and just below 90°, and preferably between 45° and 70°, preferably about 60°. Other angles are however not excluded and can depend on the design of the complete chamber and operational parameters (overpressure, mass flow rate, . . . ). At a continuous narrowing, the side walls can be a straight line, as will be described in example 1, or a curve, for example a parabola or another function. The narrowing itself can for example be a truncate cone, or a truncate paraboloid or other geometrical figures.

Finally, as said, combinations of stepped narrowing and continuous narrowing are also possible.

The above-mentioned stepped and/or continuous narrowing are configured for avoiding a too strong practical passage narrowing through a too narrow vena contracta (narrowest practical passage, where a flow moves), in which the practical flow section at an abrupt narrowing is much smaller than the physical flow section. In this way, the diameter of the yarn inlet and of the yarn outlet can be minimized without further narrowing due to the effect of the vena contracta. By minimizing the diameter of the yarn inlet and the yarn outlet, the yarn can be positioned more precisely in the whether or not tangential air flow. This can cause a decrease of the used flow section up to 64%. By means of the optimal passage from the chamber with a large flow passage to the narrowing, a non-abrupt passage, as said, will at least partially solve this problem. Moreover, the avoidance of vena contracta comes along with a turbulence, in which the turbulence becomes stronger as the effect of the vena contracta increases. As said, a stronger turbulence leads to energy losses and must therefore be avoided or limited. In addition, the invention is not at all limited to the embodiments described in the present document, but it included all combinations thereof.

In a last aspect, the invention relates to a system of two or more separate air jet devices (preferably two) for manipulating yarns through an air flow, in which the air jet devices are as described in the present document, and in which the air jet devices are arranged for operating in parallel, and so that the processed yarns are discharged at the same side. This does not only allow an easier installation and adjustment of such a system, but also allow a more efficient process. In practice, for alternately S/Z twisting yarns, two separate yarns must be twisted before they can be tacked. By having the separate air jet devices working in parallel, the distance over which the yarns must be led before being tacked, can be limited. This distance should be kept as short as possible, both for avoiding the so-called 'de-twisting' and other problems, and for having to keep the yarns as short as possible in twisted position.

In the following, the invention will be described by means of non-limiting examples illustrating the invention. These examples are not meant or cannot be interpreted as limiting the scope of the invention. The figures in the examples are, unless otherwise specified, not provided with preferred dimensions or angles or ratios and cannot be interpreted as such.

EXAMPLES

Example 1

In a first example of the form of an air jet device (4), and more in particular the chamber (41) thereof, it is referred to FIG. 1A. Here, the longitudinal cross-section is shown, along the longitudinal axis of the chamber (41), in which the chamber (41) narrows towards the yarn inlet (44) and also towards the yarn outlet (43), in a continuous way. The angle (θ) under which the chamber (41) narrows, can vary, and can for example be 20°, 25°, 30°, 35°, 40°, 45°, 50°, 55°, 60°, 65°, 70° or more, but it can also almost be a curve, or a combination of more of the above-said routes. The yarns is fed centrally along the longitudinal axis of the air jet device (4) from the left to the right. An air inlet channel (42) with air inlet is visible close to the end of the yarn inlet (44) of the chamber (41), and is suitable for providing a whether or not tangential air flow around the yarn, dependent on the location and orientation of the air inlet channel (42). A second air inlet channel can also be present, preferably also at the end of the yarn inlet (44) of the chamber (41).

Figure 2:
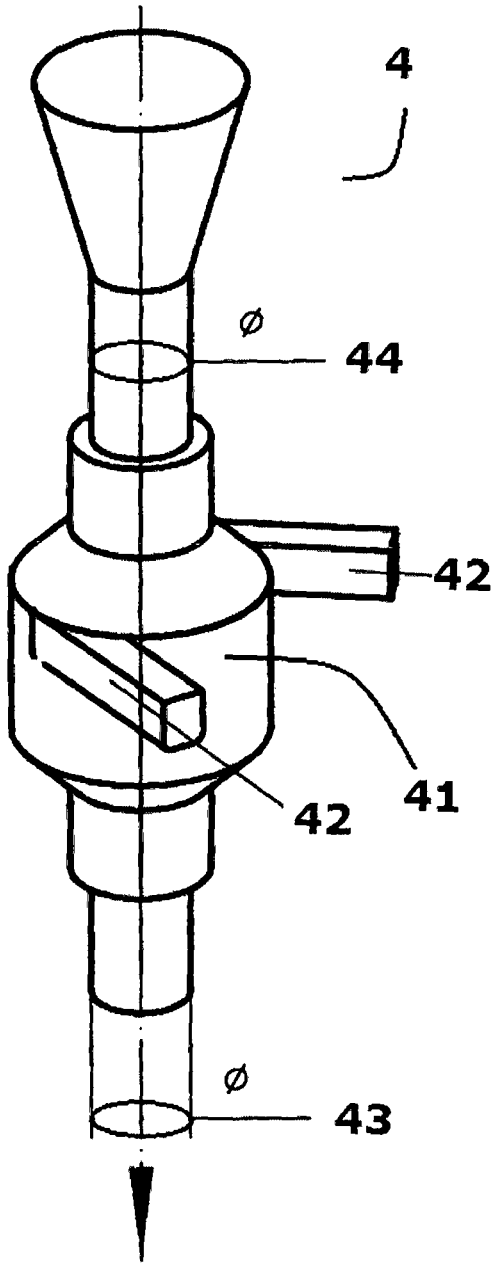
FIG. 2 shows an isometric sight of a chamber for an air jet device according to the invention.

This is also shown in isometric perspective in FIG. 2.

Figure 1B:
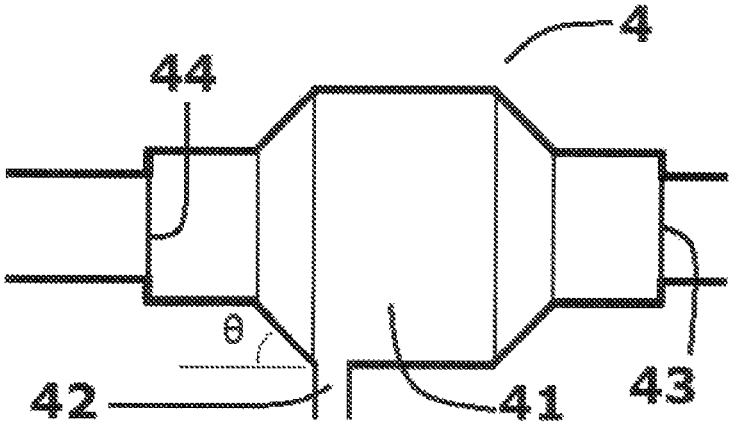

In a further detailed form, as illustrated in FIG. 1B, there is also a stepped passage after a central, cylindrical part of the chamber (41) present before the yarn outlet (43), and also a stepped passage before the central, cylindrical part of the chamber (41) after the yarn inlet (44). Optionally, this is present only at one of the ends (43, 44).

It should be further noted that at the air jet device (4), the air inlet channels (42) are oriented to cause a tangential air flow in the chamber (41), preferably with the possibility to provide this in the two rotation directions around the longitudinal axis. For so-called tack jet devices, the air inlets are oriented to provide an air flow crossing the central axis, so that one oppositely turning vortexes exist that can in this way tack the filaments of one or more yarns that are led through the tacking or intertwining device, with each other.

Example 2

Figure 1C:
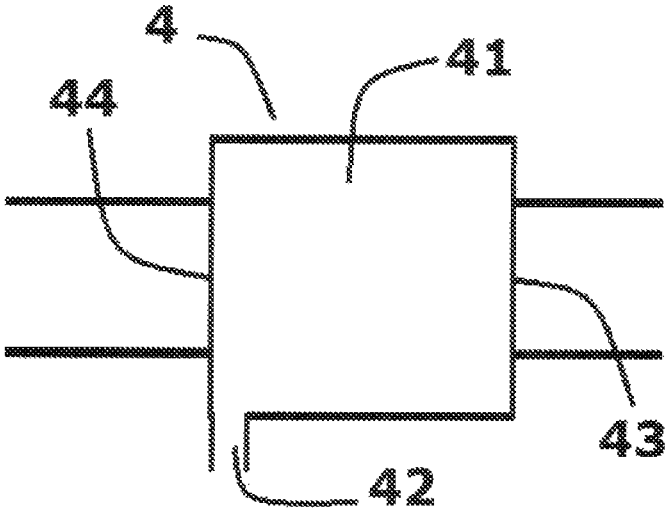
Figure 1D:
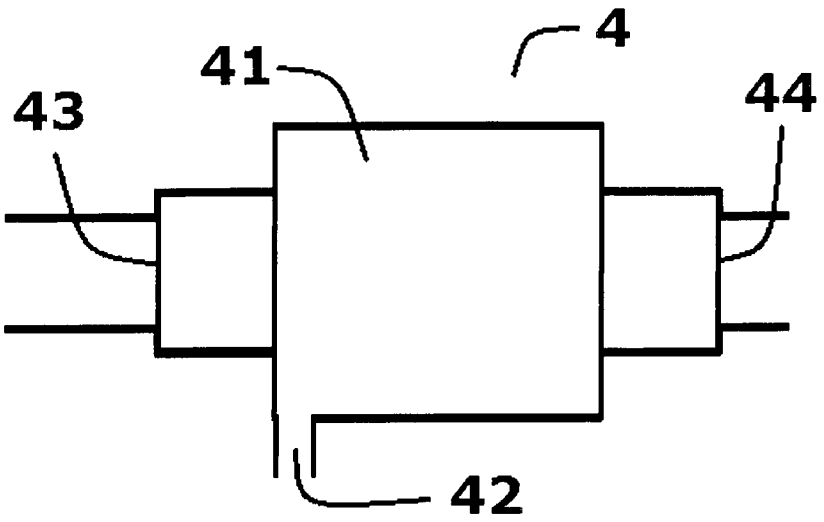

In a second example of the form of an air jet device (4), and more in particular the chamber (41) thereof, it is referred to FIG. 1C. Here, the longitudinal cross-section is shown, along the longitudinal axis of the chamber (41), in which the chamber (41) narrows abruptly towards the yarn inlet (44) and also towards the yarn outlet (43). For a description, reference is made to example 1. In a further detailed form according to FIG. 1D, there is a stepped passage after a central, cylindrical part of the chamber (41) present before the yarn outlet (43), and also a stepped passage before the central, cylindrical part of the chamber (41) after the yarn inlet (44). Optionally, this is present only at one of the ends (43, 44).

Again, it will be noted that the chamber can be adjusted to serve as a tack jet device, by means of an adjusted orientation and/or location of the air inlet channels and air inlets.

Figure 1E:
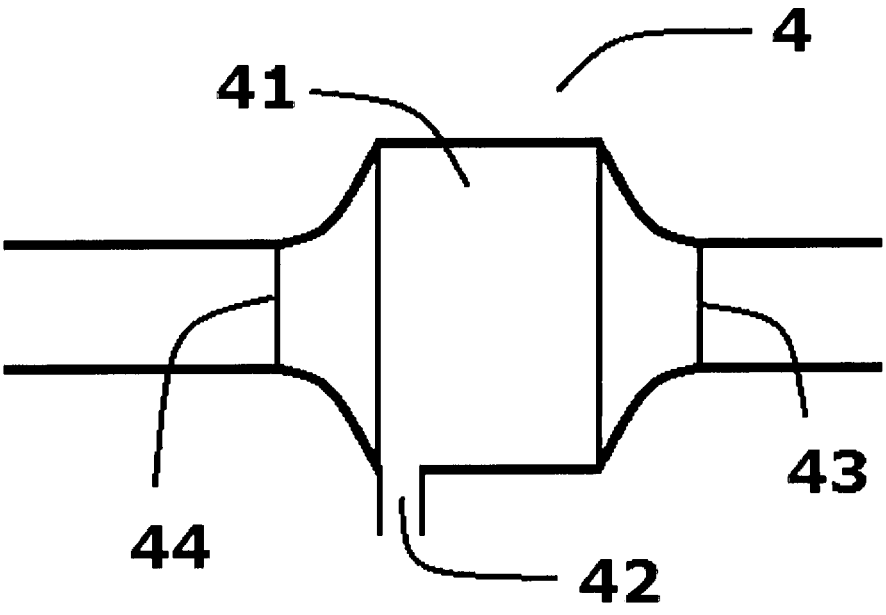

In a further embodiment, a curved passage can also be provided from the chamber to the yarn inlet and yarn outlet, as is illustrated in FIG. 1E.

Example 3

Figure 3:
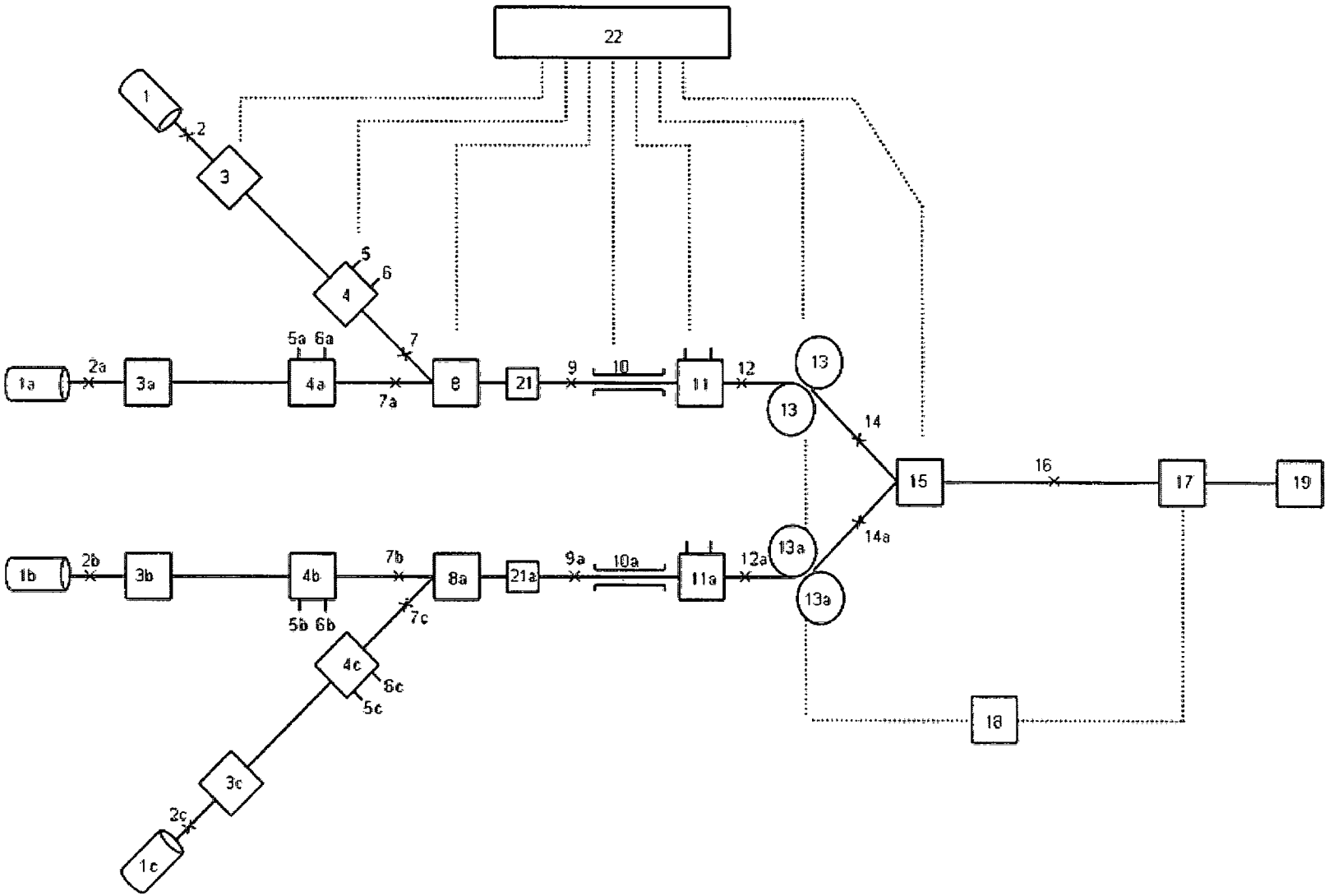
FIG. 3 show a system for fabricating n alternating S/Z cables yarns according to the invention.

In this example, the system for fabricating alternating S/Z cables yarns of FIG. 3 is discussed, as well as the method for operating such device.

The illustrated method is a continuous process: i.e. the introduced yarns and the produced yarns are led continuously through the process and the device at a speed of 200-1500 m/min and even at high speeds, and this without intermittent stops. The individual yarns (2, 2*a*, 2*b* and 2*c*) come from a yarn supply. This are mostly bobbins (1, 1*a*, 1*b* and 1*c*).

By means of yarn tensioners (3, 3*a*, 3*b* and 3*c*), the yarns (2, 2*a*, 2*b* and 2*c*) are brought to the desired yarn tension, and subsequently led to the air jet devices (4, 4*a*, 4*b* and 4*c*).

Such air jet devices are generally known: by alternately introducing compressed air at the air inlets and/or air inlet channels (5 and 6, resp. 5*a* and 6*a*, 5*b* and 6*b* and 5*c* and 6*c*) alternating S/Z twisted yarns (7, 7*a*, 7*b* and 7*c*) are produced at the discharge side of the air jet devices.

Immediately after the air jet devices (4 and 4*a*), the alternating twisted yarns (7 and 7*a*) are joined, preferably in phase. This means, with the zones of equal twist direction and the short zones next to each other.

This joining can take place in the node fixator (8), that connects the short zones of the alternating twisted yarns (7 and 7*a*) with each other. A node fixator (8) refers to a fixator for fixing torsion-free short zones to each other. Such node fixator can be an intertwining jet (device) or tack jet (device), as is generally known in the industry. In parallel, the same happens with the yarns (7*b* and 7*c*): they are joined as soon as possible, and their short zones are connected in node fixator (8*a*).

By means of a self-twist process, an alternating S/Z twist plied yarn (9 resp. 9*a*) with alternating zones of S twist and Z twist is fabricated immediately after the node fixator (8 resp. 9*a*), with in between the short zones.

In the overtwist jet or cabling device (11 resp. 11*a*), the alternating twist plied yarns (9 resp. 9*a*) are in turn twisted alternately, preferably in phase with the already formed alternating S/Z twist ply on the alternating twist plied yarns. In this way, the unbalanced alternating S/Z twist plied yarns (12 and 12*a*) are created.

These yarns (12 and 12*a*) are also joined as soon as possible, and their short zones are connected to each other in a node fixator (15).

However, the overtwisting creates a very high yarn tension, as a result of which the fibres or filaments in the short zones cannot easily be tack with each other anymore. Moreover, the fibres or filaments only have limited movement freedom with respect to early made internodal connections between the alternating S/Z twisted yarns. Therefore, optionally, between the overtwist jets (11 resp. 11*a*) and the node fixator (15), a yarn supply (13 resp. 13*a*) is provided, so that the yarn tension in the unbalanced alternating S/Z twist plied yarns (14 resp. 14A) can be reduced to a suitable level for a good operation of the node fixator (15).

The yarn supplies (13 and 13*a*) can in the generally known ways be carried out, such as nipping rolls, capstan overfeed rolls, open-roll systems, ridged rolls, belt nips or evens by means of air.

If the unbalanced alternating S/Z twist plied yarns (14 and 14*a*) are joined in phase, they will spontaneously start to self-twist after the node fixator (15), so that an alternating S/Z cabled yarn (16) is created. The yarn tension reduction with respect to the yarn supply (13 and 13*a*) also improves this self-twist process.

If the unbalanced alternating S/Z twist plied yarns (14 and 14*a*) are joined in counter-phase, they will not start to self-twist after the node fixator (15). The torsion tensions in both yarns are namely opposite.

The connection of the short zones in both yarns (14 and 14*a*) enables both yarns to maintain their unbalanced twist, also over the short zones, and the produced yarn(16) is essentially made of both yarns (14 and 14*a*) next to each other, however not connected to each other in the short zones, as so-called connected alternating S/Z twist plied yarns.

In a preferred embodiment of the invention, a control system (18) regulated the yarn supplies (13 and 13*a*) based on a yarn tension meter (17), that measures the tension on the yarn (16), so that the yarn tension variations between the node fixator (15) and the following process (19) can be minimized.

In another embodiment of the invention, the tensiometer (17) is replaced by a member that can accumulate an amount of yarn between node fixator (15) and the following process (19), for example a dancer arm; in this case, the yarn supplysystems (13 and 13*a*) are regulated base on the amount of accumulated yarns, for example by measuring the position of the dancer arm.

In another embodiment of the invention, the alternating S/Z twist plied yarns (9 and 9*a*) are heated before the overtwist jets (11 and 11*a*), by means of generally known yarn heaters (10 and 10*a*), such as infrared heaters, to soften the filaments and additionally improve the 'tackiness' of the short zones in the node fixator (15). In this way, the twisting levels can also be increased when overtwisting.

In still another preferred embodiment of the invention, a hot fluid such as hot air or steam is used in the overtwist jets, to soften the filaments and additionally improve the 'tackiness' of the short zones in the node fixator (15). In this way, the twisting levels can also be increased when overtwisting.

In a further preferred embodiment of the invention, a hot fluid such as hot air or steam is used in the node fixator (15), to soften the filaments and additionally improve the 'tackiness' of the short zones in the node fixator (15).

In still another preferred embodiment of the invention, also some fluid additives can be applied to the fibres or filaments, to reduce mutual friction, and thus to additionally improve the 'tackiness' of the short zones in the node fixator (15). These additives can be applied to the yarns with generally known applicators (21 and 21*a*) (kiss-roll moistening jets, etc.) in the yarn path before the node fixator (15), or they can be mixed with the fluid in the node fixator (15).

Finally, in each of the embodiments, a control unit (22) must be provided for the coordinated control of all of the actuators.

Example 4, 5 and 6

In a first possible embodiment according to FIG. 2, the dimensions are as follows: The air inlet channels (42) have a cross-section of about 0.4 mm, in which the yarn outlet (43), and preferably also the yarn inlet (42), have a diameter of about 1.7 mm.

In a second possible embodiment according to FIG. 2, the dimensions are as follows:

The air inlet channels (42) have a cross-section of about 1.2 $mm^2$, in which the yarn outlet (43), and preferably also the yarn inlet (42), have a diameter of about 2.1 mm.

In a third possible embodiment according to FIG. 2, the dimensions are as follows: The air inlet channels (42) have a cross-section of about 1.6 $mm^2$, in which the yarn outlet (43), and preferably also the yarn inlet (42), have a diameter of about 2.7 mm.

For these dimensions, the applicant has noted for twist jets (devices for applying a torsion to one or more yarns) that at lower overpressures (lower than 9 bar, and even at overpressures of 3 to 6 bar), a critical air flow is obtained a the yarn outlet, in which a sufficient torsion was applied to the yarn.

Example 7

Figure 4A:
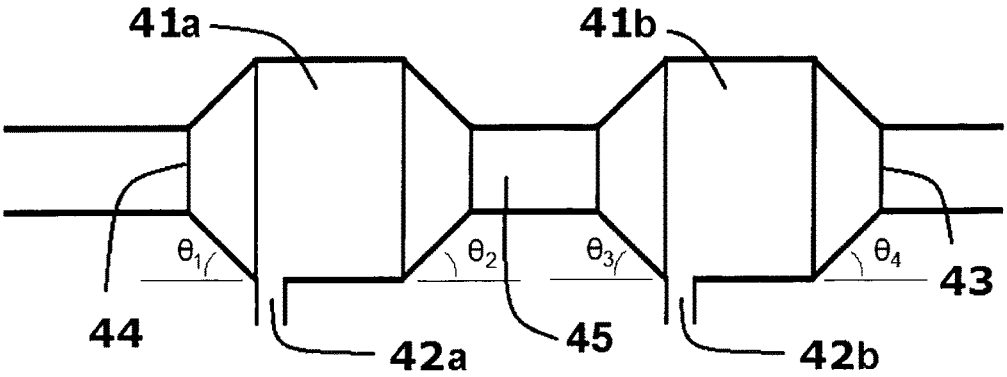
FIG. 4A, FIG. 4B, FIG. 4C, FIG. 4D, FIG. 4E, FIG. 4F and FIG. 4G show a longitudinal cross-section of an air jet device for applying torsion to yarns, with two successive chambers according to a possible embodiment.
Figure 4B:
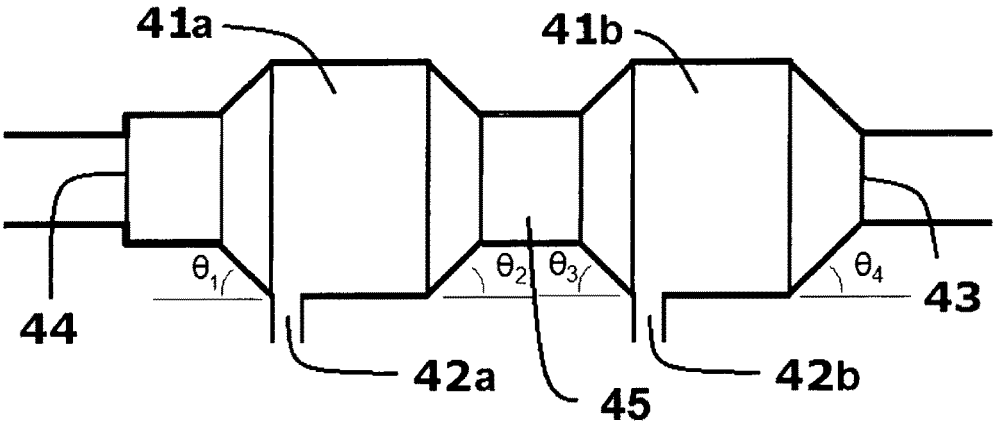
Figure 4C:
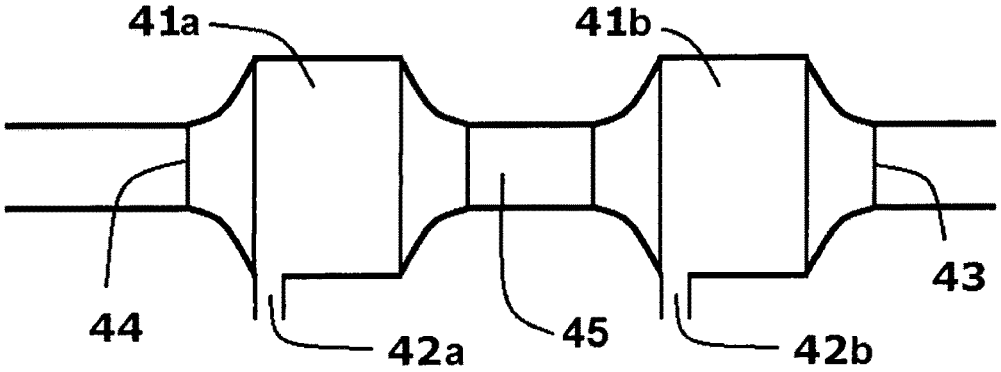
Figure 4D:
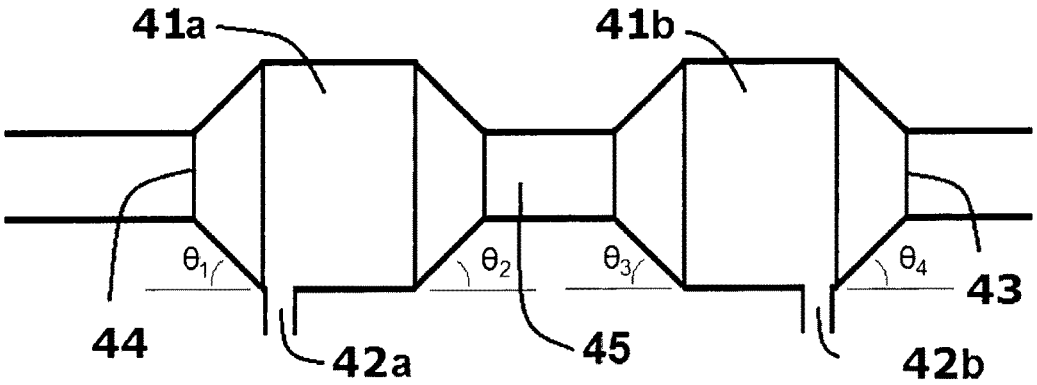
Figure 4E:
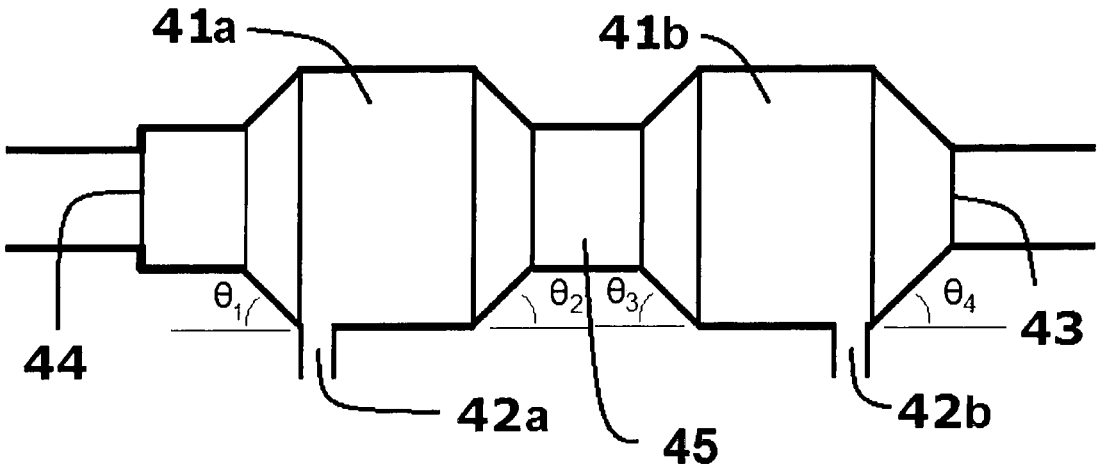
Figure 4F:
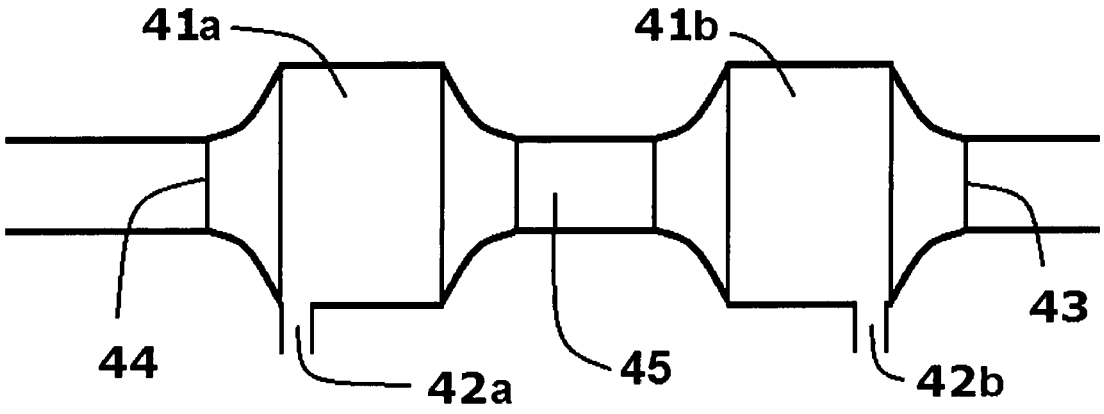
Figure 4G:
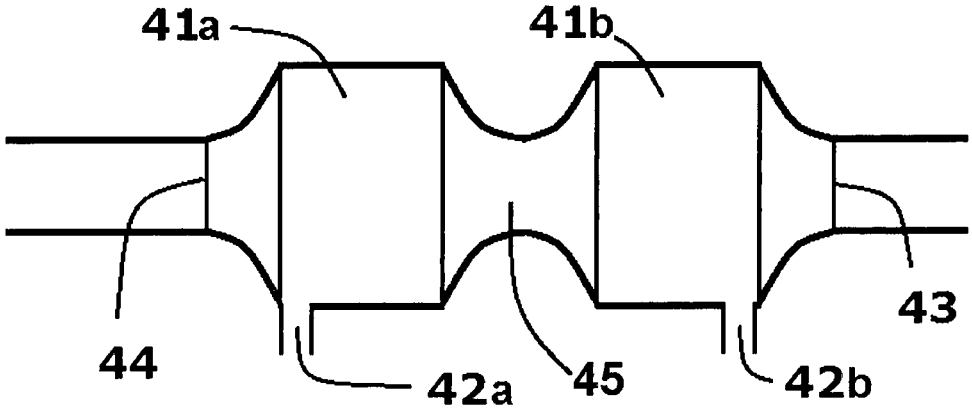

In a possible embodiment, an air jet device is provided with two successive chambers (41*a* and 41*b*). In this respect, different designs are possible, in which different types of chambers are combined, of which examples are shown in FIG. 1A-1E, and described in EXAMPLE 1. Possible combinations thereof are described in FIG. 4A to FIG. 4G. Here, it should be noted that for the angles $\theta_1$, $\theta_2$, $\theta_3$ and $\theta_4$, there are several possibilities and that they should not necessarily be equal. Finally, it should also be noted that, although not in case of the configuration of the figures, the chambers should not perfectly follow each other and that this can occur under an angle or other asymmetries. Furthermore, it should be noted that in FIG. 4D-4G, the air inlet channels (42*b*) of the second chamber (41*b*) are positioned closer to the yarn outlet (43) of the second chamber (41*b*). Here, it should also be noted that in FIG. 4G, the chamber passage must not explicitly be present, since a yarn outlet of the first chamber (41*a*) can pass continuously to a yarn inlet of the second chamber (41*b*).

Both chambers (41*a* and 41*b*) are provided with air inlet channels (41*a* and 42*b*), that are however positioned differently, so that both cause a substantially tangential air flow in the chambers, however with an opposite rotation direction. The first chamber (41*a*) is provided with a yarn inlet (44) and ends via a chamber passage (45) into the second chamber (41*b*) that has a yarn outlet (43) at the other end. Possible dimensions have already been cited in EXAMPLE 4, 5 and 6.

Example 8

Figure 5A:
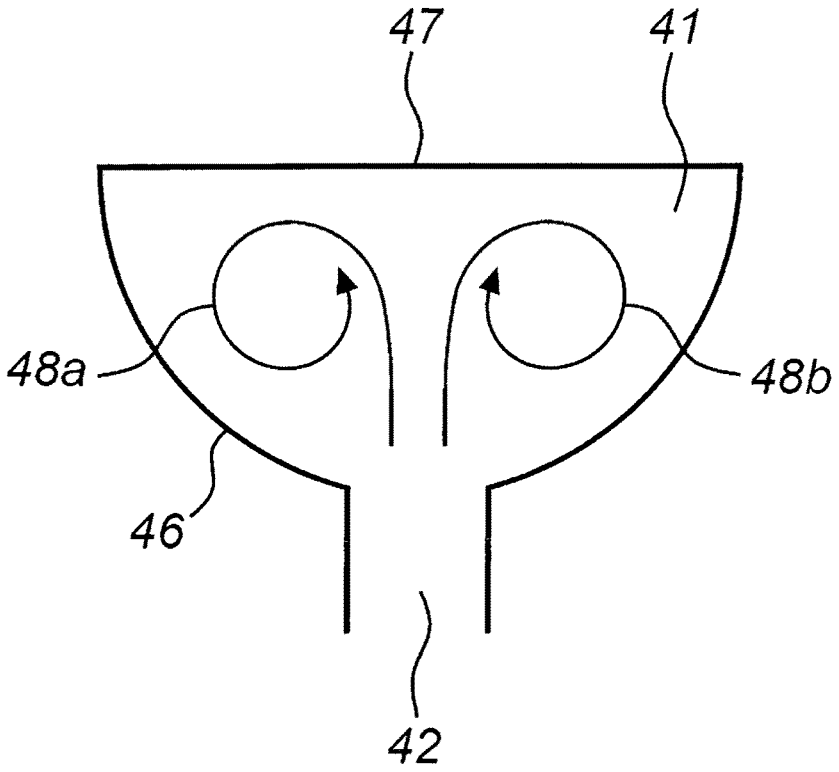
FIG. 5A, FIG. 5B and FIG. 5C show cross-sections of an air jet device for tacking (filaments of) yarns according to a possible embodiment, FIG. 5A show a transversal cross-section.
Figure 5B:
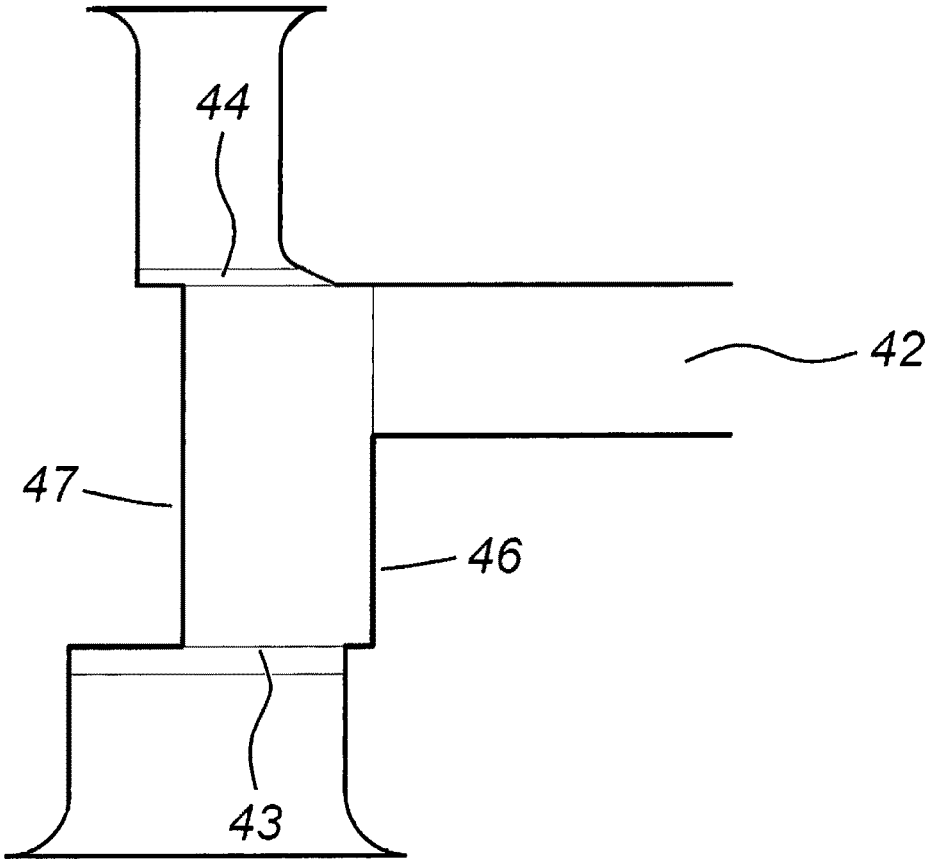
Figure 5C:
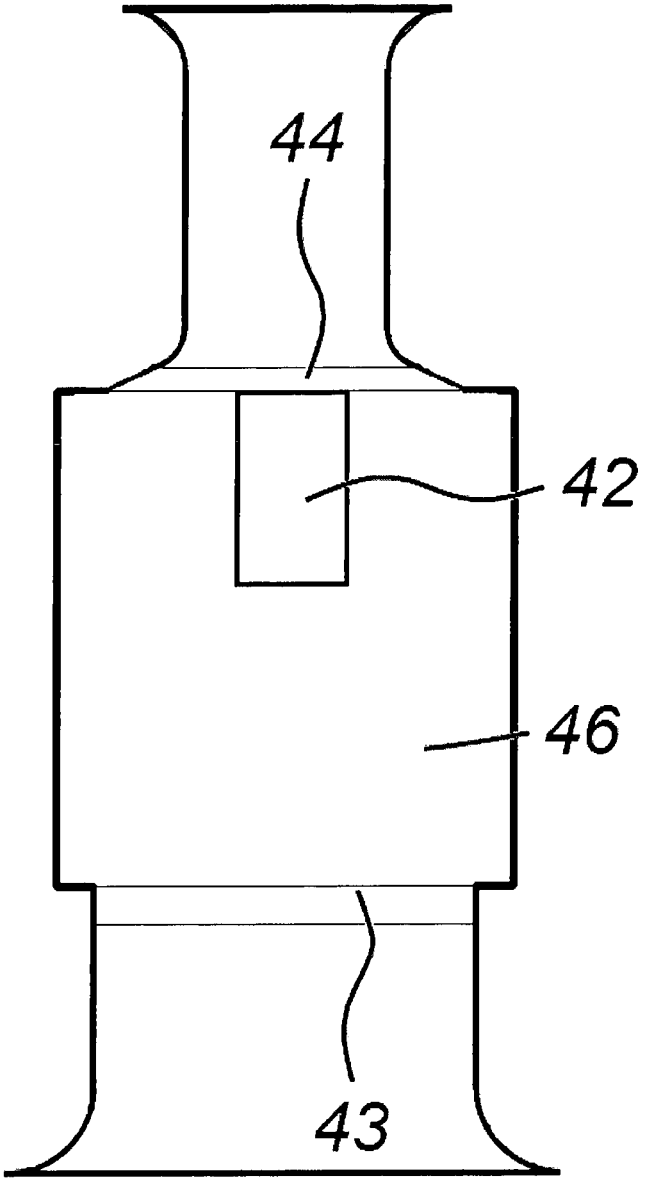

A possible embodiment of a so-called tacking device (or tack jet) is shown in FIG. 5A, FIG. 5B and FIG. 5C. The chamber (41) is adapted because the air inlet channel (42) is suitable for providing a radial air flow in the chamber (41), and because the air inlet channels (42) is provided more closely to the yarn outlet (43) than to the yarn inlet (44) as is illustrated in FIG. 5B. Moreover, the yarn outlet (43) has a smaller cross-section that the yarn inlet (44). In this embodiment, the chamber (41) has a cross-section in the form of a semi-circle, in which the air inlet channel (42) ends at the convex side (46) opposite to the flat wall (47), as is clearly illustrated in FIG. 5A. In this way, air flows from this air inlet channel (42) are directed towards the opposite flat wall (47), so that they cause two vortex flows (48*a*, 48*b*) that have however an opposite rotation direction, as is illustrated in FIG. 5A. The vortex flows (48*a*, 48*b*) are suitable for manipulating filaments of yarns that are led through the chamber (41) and in this way tacking them to each other, in order to connect the yarns.

It will be clear that the present invention is not limited to the embodiments that have been described above and that some adjustments or modifications can be added to the described examples still falling with the scope of the attached claims. The present invention has for example been described with reference to the application of an alternating S/Z torsion to a yarn, but it will be clear that the invention, as well as methods, torsion members and devices can be applied to e.g. several yarns in a chamber, or other raw materials than yarns, or for applying one single, non-alternating torsion to a yarn, or to several, twisted or not, yarns, or for tacking the filaments of one or more yarns.

The invention claimed is:

1. System for fabricating alternating S/Z twist plied yarns, comprising:

(a) a feeding member for separately feeding at least two individual yarns;

(b) a member for tensioning every yarn;

(c) at least two air jet devices, for alternately applying a, respectively, S and Z torsion in at least two of the individual yarns, for obtaining at least one S/Z twisted yarn, in which zones without net twist separate zones with S torsion of the at least one S/Z twisted yarn from zones with Z torsion of the at least one S/Z twisted yarn;

(d) a fixation member for joining the at least two individual yarns, and for connecting the alternating S/Z twisted yarns at the place of the zones without net twist, for obtaining alternating S/Z twist plied yarns;

(e) a control member for combining the feeding member, the member for tensioning every yarn and the fixation member in a coordinated way;

wherein at least one of the at least two air jet devices is an air jet device comprising:

(a) a longitudinally extending chamber comprising:

(i) one or more side walls;

(ii) a yarn inlet at a first longitudinal end of the chamber, in which the yarn inlet has a cross-sectional area;

(iii) a yarn outlet at a second longitudinal end of the chamber, in which the yarn outlet has a cross-sectional area, in which the first and the second longitudinal end are located oppositely;

(iv) and one or more air inlets;

(b) one or more air inlet channels for creating an air flow, said one or more air inlet channels ending in the one or more side walls of the chamber, in which said one or more air inlet channels have a cross-sectional area and said one or more air inlet channels are oriented so that the one or more air inlet channels are suitable for generating an air flow in the chamber;

wherein the ratio of the cross-sectional area of the yarn outlet of the chamber to the cross-sectional area of said one or more air inlet channels for generating the air flow is such that a critical air flow can be provided at the yarn outlet of the chamber when a predetermined overpressure is applied at the one or more air inlets, wherein the ratio of the cross-sectional area of the yarn outlet to the cross-sectional area of the one or more air inlet channels generating the air flow, is between 1.5 and 8.

2. System for fabricating alternating S/Z cabled yarns or a connected alternating S/Z twist plied yarn, comprising:

(a) at least two systems for fabricating alternating S/Z twist plied yarns, in which the systems are adapted to work in parallel;

(b) at least two overtwisting air jet devices, for alternately applying a, respectively, S and Z torsion in at least two of the alternating S/Z twist plied yarns, for obtaining at least two overtwisted alternating S/Z twist plied yarns, in which zones approximately without net twist separate zones with S torsion of the alternating S/Z twist plied yarns and zones with Z torsion of the alternating S/Z twist plied yarns, and in which the zones approximately without net twist of the overtwisted alternating S/Z twist plied yarns coincide with the zones approximately without net twist of the alternating S/Z twist plied yarns;

(c) at least one feeding member for feeding the alternating S/Z twist plied yarns of the system for fabricating alternating S/Z twist plied yarns to the at least two overtwisting air jet devices;

(d) a second fixation member for joining the overtwisted alternating S/Z twist plied yarns, and for connecting the overtwisted alternating S/Z twist plied yarns at the place of the zones approximately without net twist, for obtaining alternating S/Z cabled yarn or connected alternating S/Z twist plied yarn;

wherein at least one of the systems for fabricating alternating S/Z twist plied yarns is a system of claim 1.

3. The system of claim 2 for fabricating an alternating S/Z cabled yarn, wherein at least one of the overtwisting air jet devices alternately applying the, respectively, S and Z torsion in the separate alternating S/Z twist plied yarns, is an overtwisting air jet device comprising:

(a) a longitudinally extending chamber comprising:

(i) one or more side walls;

(ii) a yarn inlet at a first longitudinal end of the chamber, in which the yarn inlet has a cross-sectional area;

(iii) a yarn outlet at a second longitudinal end of the chamber, in which the yarn outlet has a cross-sectional area, in which the first and the second longitudinal end are located oppositely;

(iv) and one or more air inlets;

(b) one or more air inlet channels for creating an air flow, said one or more air inlet channels ending in the one or more side walls of the chamber, in which said one or more air inlet channels have a cross-sectional area and said one or more air inlet channels are oriented so that the one or more air inlet channels are suitable for generating an air flow in the chamber;

wherein the ratio of the cross-sectional area of the yarn outlet of the chamber to the cross-sectional area of said one or more air inlet channels for generating the air flow is such that a critical air flow can be provided at the yarn outlet of the chamber when a predetermined overpressure is applied at the one or more air inlets, wherein the ratio of the cross-sectional area of the yarn outlet to the cross-sectional area of the one or more air inlet channels generating the air flow, is between 1.5 and 8.

4. System for fabricating alternating S/Z twist plied yarns of claim 1, in which a critical air flow can also be provided at the yarn inlet of the chamber when the predetermined overpressure is applied to the air inlets.

5. System for fabricating alternating S/Z twist plied yarns of claim 1, wherein the ratio of the cross-section of the yarn outlet to the cross-sectional area of the one or more air inlet channels generating the air flow, is between 2 and 6.

6. System for fabricating alternating S/Z twist plied yarns of claim 1, wherein the predetermined range of overpressure at the one or more air inlets for generating the critical air flow at the yarn outlet, is between 1 and 7 bar.

* * * * *